US006128456A

United States Patent [19]

Chigono et al.

[11] Patent Number: 6,128,456

[45] **Date of Patent: *Oct. 3, 2000**

[54] IMAGE FORMING APPARATUS HAVING A CHARGING MEMBER APPLYING AN ELECTRIC CHARGE THROUGH ELECTRICALLY CONDUCTIVE OR ELECTROCONDUCTIVE PARTICLES TO THE SURFACE OF A PHOTOSENSITIVE OR IMAGE BEARING MEMBER

[75] Inventors: Yasunori Chigono, Susono; Yukio Nagase, Shizuoka-ken; Harumi Ishiyama; Jun Hirabayashi, both of Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/035,022

[22] Filed: Mar. 5, 1998

[30] Foreign Application Priority Data

| | | | |
|---|---|---|---|
| Mar. 5, 1997 | [JP] | Japan | 9-067426 |
| Mar. 5, 1997 | [JP] | Japan | 9-067429 |
| Jun. 12, 1997 | [JP] | Japan | 9-170996 |

[51] Int. Cl.[7] ..... G03G 15/02

[52] U.S. Cl. ..... 399/176; 399/150

[58] Field of Search ..... 399/176, 115, 399/116, 149, 150, 159, 161, 174, 175; 430/102, 109, 110, 111; 492/48, 49, 56

[56] References Cited

U.S. PATENT DOCUMENTS

| | | | |
|---|---|---|---|
| 4,401,740 | 8/1983 | Kawabata et al. | 430/102 |
| 5,221,946 | 6/1993 | Kohyama | 399/150 |
| 5,432,037 | 7/1995 | Nishikiori et al. | 430/126 |
| 5,576,808 | 11/1996 | Ikegawa et al. | 399/175 |
| 5,579,095 | 11/1996 | Yano et al. | 399/175 |
| 5,587,774 | 12/1996 | Nagahara et al. | 399/176 |
| 5,587,775 | 12/1996 | Taniguchi et al. | 399/175 |
| 5,597,673 | 1/1997 | Watanabe et al. | 430/110 X |
| 5,606,401 | 2/1997 | Yano | 399/175 |
| 5,652,649 | 7/1997 | Ikegawa et al. | 399/175 |
| 5,754,927 | 5/1998 | Ishiyama et al. | 399/176 |
| 5,822,659 | 10/1998 | Ishiyama | 399/175 |

FOREIGN PATENT DOCUMENTS

| | | |
|---|---|---|
| 0689 102 | 6/1995 | European Pat. Off. . |
| 0747 780 | 12/1996 | European Pat. Off. . |
| 63-149699 | 6/1988 | Japan . |
| 3-103878 | 4/1991 | Japan . |
| 6-003921 | 1/1994 | Japan . |
| 7-99442 | 10/1995 | Japan . |

*Primary Examiner*—Sandra Brase
*Assistant Examiner*—Hoan Tran
*Attorney, Agent, or Firm*—Fitzpatrick, Cella, Harper & Scinto

[57] ABSTRACT

An image forming apparatus includes an image bearing member with a recirculatively movable peripheral surface; and a device for forming electrostatic latent images on the peripheral surface of the image bearing member, the device including a charging member to which voltage is applicable to charge the image bearing member. The charging member includes a flexible member capable of forming a nip between itself and the image bearing member; a developer for developing the latent image with the use of developer composed of toner particles and electrically conductive particles. The developer is capable of cleaning the residual toner particles from the image bearing member. The electrically conductive particles transferred onto the image bearing member by the developer are delivered to the nip by the image bearing member. The flexible member is moved so that it maintains a peripheral velocity difference relative to the image bearing member.

33 Claims, 6 Drawing Sheets

IMAGE FORMING APPARATUS HAVING A CHARGING MEMBER APPLYING AN ELECTRIC CHARGE THROUGH ELECTRICALLY CONDUCTIVE OR ELECTROCONDUCTIVE PARTICLES TO THE SURFACE OF A PHOTOSENSITIVE OR IMAGE BEARING MEMBER

FIELD OF THE INVENTION AND RELATED ART

The present invention relates to image forming apparatuses such as copy machines or printers.

More specifically, the present invention relates to image forming apparatuses compatible with contact-type charging systems, transfer type systems, and toner recycling systems.

Prior to the present invention, a corona type charger (corona discharging device) has been widely used as a charging apparatus for charging (inclusive of discharging) an image bearing member, such as an electrophotographic photosensitive member or an electrostatic dielectric recording member, to a predetermined polarity and a predetermined potential level in an image forming apparatus, for example, an electrophotographic apparatus or an electrostatic recording apparatus.

The corona type charging device is a noncontact-type charging device, and comprises a corona discharging electrode, such as a wire electrode, and a shield electrode, which surrounds the corona discharging electrode. It is disposed so that the corona discharging opening thereof faces an image bearing member, that is, an object to be charged. In usage, the surface of an image bearing member is charged to a predetermined potential level by being exposed to discharge current (corona shower) generated as high voltage, which is applied between the corona discharging electrode and the shield electrode.

In recent years, it has been proposed to employ a contact-type charging apparatus as a charging apparatus for charging the image bearing member, that is, the object to be charged, in an image forming apparatus of low to medium speed. This is due to the fact that a contact-type charging apparatus has an advantage over a corona type charging apparatus in terms of low ozone production, low power consumption, or the like. Also, such a contact-type charging apparatus has been put to practical use.

In order to charge an object, such an image bearing member, with the use of a contact-type charging apparatus, the electrically conductive charging member (contact-type charging member, contact-type charging device, or the like) of a contact-type apparatus is placed in contact with the object to be charged, and an electrical bias (charge bias) of a predetermined level is applied to this contact-type charging member so that the surface of the object to be charged is charged to a predetermined polarity and a predetermined potential level. The charging member is available in various forms, for example, a roller type (charge roller), a fur brush type, a magnetic brush type, a blade type, and the like.

In reality, when an object is electrically charged by a contact-type charging member, two types of charging mechanisms (charging system or charging principle: (1) a system which discharges an electrical charge, and (2) a system for injecting charge) come into action. Thus, the characteristics of each of the contact-type charging apparatuses or methods are determined by the charging system which is the dominant one of the two in charging the object.

(1) Electrical-discharge based charging system

This charging system is a charging system in which the surface of an object to be charged is charged to electrical discharging, which occurs across a microscopic gap between a contact-type charging member and the object to be charged.

In the case of the electrical-discharge based charging system, there is a threshold voltage which must be surpassed by the charge bias applied to a contact-type charging member before electrical discharge occurs between a contact-type charging member and an object to be charged, and therefore, in order for an object to be charged through the electrical-discharge based charging system, it is necessary to apply to the contact-type charging member a voltage with a value greater than the value of the potential level to which the object is to be charged. Thus, in principle, when the electrical-discharge based charging system is in action, it is impossible to avoid generating the by-products of electrical discharge, that is, active ions such as ozone ions. In reality, even a contact-type charging apparatus charges an object partially through the electrical-charge discharging system as described above, and therefore, a contact-type charging apparatus cannot completely eliminate the problems caused by the active ions such as ionized ozone.

(2) Direct-charge injection system

This is a system in which the surface of an object to be charged as electrical charge is directly injected into the object to be charged, with the use of a contact-type charging member. Thus, this system is called "direct charging system", or "charge injection system". More specifically, a contact-type charging member with medium electrical resistance is placed in contact with the surface of an object to be charged to directly inject electrical charge into the surface portion of an object to be charged, without relying on electrical discharge, in other words, without using electrical discharge in principle. Therefore, even if the value of the voltage applied to a contact-type charging member is below the discharge starting voltage value, the object to be charged can be charged to a voltage level which is substantially the same as the level of the voltage applied to the contact-type charging member.

This direct injection charging system does not suffer from the problems caused by the by-products of electrical discharge since it is not accompanied by ozone production. However, in the case of this charging system, the state of the contact between a contact-type charging member and an object to be charged greatly affects the manner in which the object is charged, since this charging system is such a system that directly charges an object. Thus, this direct injection charging system should comprise a contact-type charging member composed of high density material, and also should be given a structure which affords a large speed difference between the charging member and the object to be charged, so that a given point on the surface of the object to be charged makes contact with a larger area of the charging member.

A) Charging apparatus with charge roller

In the case of a contact-type charging apparatus, a roller charge system, that is, a charging system which employs an electrically conductive roller (charge roller) as a contact-type charging member, is widely used because of its desirability in terms of safety.

As for the charging system in this roller charge system prior to the present invention, the aforementioned (1) charging system, which discharges electrical charge, is dominant.

Charge rollers are formed of rubber or foamed material with substantial electrical conductivity, or electrical resistance of a medium level. In some charge rollers, the rubber or foamed material is layered to obtain a specific characteristic.

In order to maintain stable contact between a charge roller and an object to be charged (hereinafter, a "photosensitive member"), a charge roller is given elasticity, which in turn increases frictional resistance between the charge roller and the photosensitive member. Also in many cases, a charge roller is rotated by the rotation of a photosensitive drum, or is individually driven at a speed slightly different from that of the photosensitive drum. As a result, problems occur: absolute charging performance declines, the state of the contact between the charge roller and the photosensitive drum becomes less desirable, and foreign matter adheres to the charge roller and/or the photosensitive member. Prior to the present invention, the dominant charging system through which a roller charging member charged an object was a charging system, which discharged electrical charge, and therefore, even with the use of a contact-type charging apparatus, it was impossible to completely prevent the nonuniform charging of the photosensitive member.

FIG. 3 is a graph which shows an example of efficiency in contact-type charging. In the graph, the abscissas represents the bias applied to a contact-type charging member, and the axis of ordinate represents the potential levels corresponding to the voltage values of the bias applied to the contact-type charging member. The characteristics of the charging by a roller are represented by a line designated by a character A. According to this line, when a charge roller is used to charge an object, the charging of an object occurs in a voltage range above an electric discharge threshold value of approximately −500 V. Therefore, generally, in order to charge an object to a potential level of −500 V with the use of a charge roller, either a DV voltage of −1000 V is applied to the charge roller, or an AC voltage with a peak-to-peak voltage of 1200 V, in addition to a DC voltage of −500 V, is applied to the charge roller to keep the difference in potential level between the charge roller and the object to be charged, at a value greater than the electric discharge threshold value, so that the potential of the photosensitive drum converges to the desired potential level.

More specifically, in order to charge a photosensitive drum with a 25 $\mu$m thick organic photoconductor layer by pressing a charge roller upon the photosensitive member, a charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage Vth.

In other words, in order to charge the surface of a photosensitive member to a potential level of Vd which is necessary for electrophotography, a DC voltage of (Vd+Vth), which is higher than the voltage level to which the photosensitive member is to be charged, is necessary. Hereinafter, the above-described charging method in which only DC voltage is applied to a contact-type charging member to charge an object will be called a "DC charging method".

However, prior to the present invention, even with the use of the DC charging method, it was difficult to bring the potential level of a photosensitive member exactly to a target level, since the resistance value of a contact charging member changed due to changes in ambience or the like, and also the threshold voltage Vth changed as the photosensitive member was shaved away.

As for a counter measure for the above-described problem, Japanese Laid-Open Patent Application No. 149,669/1988 discloses an invention which deals with the above problem to effect more uniform charging of a photosensitive member. According to this invention, an "AC charging method" is employed, in which a compound voltage composed of a DC component equivalent to a desired potential level Vd, and an AC component with a peak-to-peak voltage which is twice the threshold voltage Vth, is applied to a contact-type charging member. This invention is intended to utilize the averaging effect of alternating current. According to this invention, the potential of an object to be charged is caused to converge to the Vd, that is, the center of the peaks of the AC voltage, without being affected by external factors such as operational ambience.

However, even in the case of the contact-type charging apparatus in the above-described invention, the principal charging system is a charging system which uses electrical discharge from a contact-type charging member to a photosensitive member. Therefore, as already described, the voltage applied to the contact-type charging member needs to have a voltage level higher than the voltage level to which the photosensitive member is to be charged. Thus, ozone is generated, although only in a small amount.

Further, when AC voltage is used so that an object is uniformly charged due to the averaging effect of AC voltage, the problems related to AC voltage become more conspicuous. For example, more ozone is generated; noises associated with the vibration of the contact-type charging member and the photosensitive drum caused by the electric field of AC voltage increase; and the deterioration of the photosensitive member surface caused by electrical discharge increases, which add to the prior problems.

B) Charging apparatus with fur brush

In the case of this charging apparatus, a charging member (fur brush type charging device) with a brush portion composed of electrically conductive fiber is employed as the contact-type charging member. The brush portion, composed of electrically conductive fiber, is placed in contact with a photosensitive member as an object to be charged, and a predetermined charge bias is applied to the charging member to charge the peripheral surface of the photosensitive member to a predetermined polarity and a predetermined potential level.

Also in the case of this charging apparatus with a fur brush, the dominant charging system is the electrical-discharge base charging system.

There are two types of fur-brush-type charging devices, which have been put to practical use: a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/$cm^2$ can be relatively easily obtained, but the density of 100 fiber/$cm^2$ is not sufficient to create a state of contact which is satisfactory to directly charge an object. Further, in order to give a photosensitive member a satisfactory uniform charge by directly charging it, a velocity difference, which is almost impossible to attain with the use of a mechanical structure, must be established between a photosensitive drum and a roller type fur brush. Therefore, the fur brush type charging device is not practical.

The relationship between the DC voltage applied to a fur-brush-type charging member and the potential level to which a photosensitive member is charged by the DC voltage applied to the fur brush shows a characteristic represented by a line B in FIG. 3. As is evident from the graph, also in the case of the contact-type charging apparatus which comprises a fur brush, whether the fur brush is of the fixed type or the roller type, the photosensitive member is charged mainly through electrical discharge triggered by applying to the fur brush a charge bias, the voltage level of which is higher than the potential level desired for the photosensitive member.

C) Magnetic-brush-type charging apparatus

A charging apparatus of this type comprises a magnetic brush portion (magnetic-brush based charging device) as the contact-type charging member. A magnetic brush is constituted of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic-brush-type charging apparatus, the dominant charging system is the direct charging system (2).

As for the material for the magnetic brush portion, electrically conductive magnetic particles, the diameters of which are in a range of 5–50 $\mu$m, are used. With the provision of sufficient difference in peripheral velocity between a photosensitive drum and a magnetic brush, the photosensitive member can be directly and uniformly charged.

In the case of a magnetic-brush-type charging apparatus, the photosensitive member is charged to a potential level which is substantially equal to the voltage level of the bias applied to the contact-type charging member, as shown by a line C in FIG. 3.

However, a magnetic-brush-type charging apparatus also has its own problems. For example, it is complicated in structure. Also, the electrically conductive magnetic particles which constitute the magnetic brush portion become separated from the magnetic brush and adhere to a photosensitive member.

Japanese Publication Application No. 3921/1994 discloses a contact-type charging method, according to which a photosensitive member is charged by injecting electric charge into the charge-injectable surface layer thereof, and more specifically, into the traps or electrically conductive particles in the charge-injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise associated with the application of AC voltage. In other words, a magnetic-brush type charging system is an excellent charging system superior to the roller-type charging system in terms of ozone generation and power consumption, since it does not generate ozone, and uses far less power compared to the roller-type charging system.

D) Toner recycling process (cleanerless system)

In a transfer-type image forming apparatus, the toner which remains on the peripheral surface of a photosensitive member (image bearing member) after image transfer is removed by a cleaner (cleaning apparatus), and becomes waste toner. Not only for obvious reasons, but also for environmental protection, it is desirable that waste toner is not produced. Thus, image forming apparatuses capable of recycling toner have been developed. In such an image forming apparatus, a cleaner is eliminated, and the toner, which remains on the photosensitive member after image transfer, is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference Vback between the level of the DC voltage applied to a developing apparatus and the level of the surface potential of a photosensitive member) during the following image transfer. According to this cleaning method, this residual toner is recovered by the developing apparatus and is used for the following image development and thereafter the waste toner is eliminated. Therefore, the labor spent for maintenance is reduced. Further, being cleanerless is quite advantageous in terms of space, allowing image forming apparatuses to be substantially reduced in size.

E) Coating of contact-type charging member with electrically conductive powder

Japanese Laid-Open Patent Application No. 103878/1991 discloses a contact-type charging apparatus with such a structure that coats a contact-type charging member with electrically conductive powder, on the surface which comes in contact with the surface of an object to be charged, so that the surface of the object to be charged is uniformly charged, that is, without irregularity in charge. The contact-type charging member in this charging apparatus is rotated by the rotation of the object to be charged, and the amount of ozonic products generated by this charging apparatus is remarkably small compared to the amount of ozonic products generated by a corona-type charging apparatus such as SUKOROTRON. However, even in the case of this charging apparatus, the principle, based on which an object is charged, is the same as the principle, based on which an object is charged by the aforementioned charge roller; in other words, an object is charged by electrical discharge. Further, also in the case of this charging apparatus, in order to assure that an object to be charged is uniformly charged, compound voltage, composed of a DC component and an AC component, is applied to the contact-type charging member, and therefore, the amount of ozonic products associated with electrical discharge becomes relatively large. Thus, even this contact-type charging apparatus is liable to cause problems; for example, images are affected by ozonic products, appearing as if flowing, when this charging apparatus is used for an extended period of time, in particular, when this charging apparatus is used in a cleanerless image forming apparatus for an extended period of time.

As described in the preceding paragraphs regarding the technologies prior to the present invention, it is difficult to directly charge an object with the use of a contact-type charging member apparatus with a simple structure which comprises a contact-type charging member such as a charge roller or a fur brush, since the peripheral surface of the contact-type charging member is too rough to create a substantially gapless state of contact between itself and an image bearing member as an object to be charged.

1) Therefore, it has been desired to develop a durable structure which employs a simple contact-type charging member, such a charge roller or a fur brush, and yet is capable of directly and uniformly charging an object, and which requires only low voltage, and produces practically no ozone.

2) When a contact-type charging apparatus is employed as a means for charging the image bearing member of an image forming apparatus which employs a toner recycling process, there is no cleaner for removing the toner which remains on the peripheral surface of the image bearing member after image transfer. Therefore, the residual toner on the image bearing member is carried to a charging station, that is, the interface between the image bearing member and the contact-type charging member, as the peripheral surface of the image binary member, is moved. As a result, the residual toner contaminates the contact-type charging member, interfering with the process through which charge is directly injected from the contact-type charging member to the image bearing member, or making it practically impossible for the image bearing member to be directly charged by the contact-type charging member. If the amount of the charge which the image bearing member receives is insufficient, the amount of the toner which adheres to the contact-type charging member increases, interfering further with the charging of the image bearing member, and therefore, perpetuating this undesirable cycle. Further U.S. Pat. No. 5,432,037 discloses an invention in which electrically conductive particles are mixed into developer so that even if developer adheres to a charger roller, the charging operation is not interfered with. However, also in this case, an image bearing member is primarily charged through electrical discharge, and therefore, there are problems similar to those described above.

SUMMARY OF THE INVENTION

Accordingly, an object of the present invention is to provide a durable and reliable image forming apparatus which employs only a simple charging member, such as a charge roller or a fiber brush, and yet is capable of uniformly charging an image bearing member.

Another object of the present invention is to provide an image bearing member which employs a charging member, the voltage to be applied to which is low enough to prevent the generation of ozone and resultant ozonic products.

Another object of the present invention is to provide an image forming apparatus which comprises an inexpensive charging member from which charge is directly injected into an image bearing member.

Another object of the present invention is to provide an image forming apparatus, the developing device of which doubles as a cleaner so that even if the charging member is contaminated with toner which remains after image transfer, the charging roller is cleaned by the developing device, being enabled to desirably charge the image bearing member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
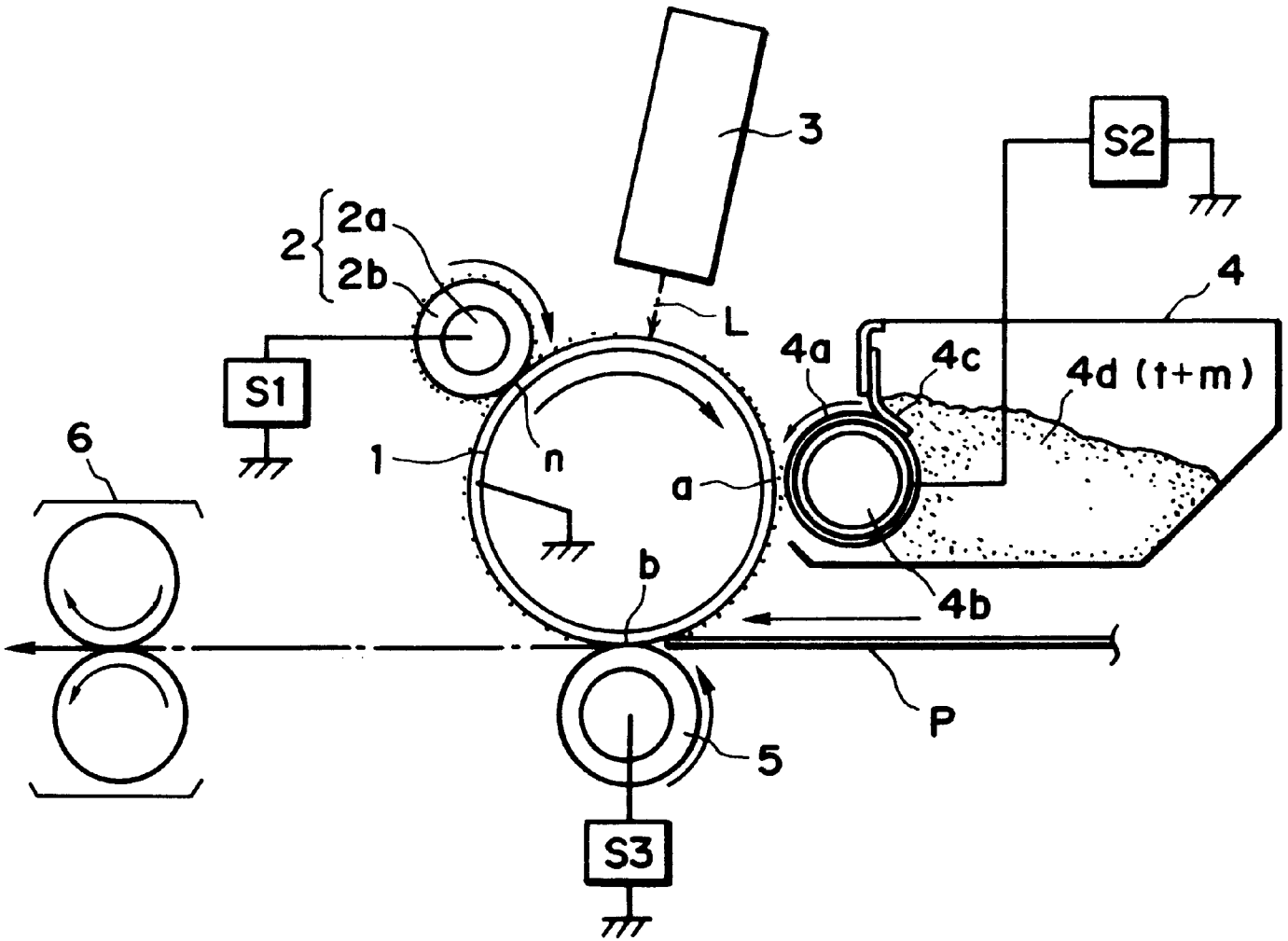
FIG. 1 is a schematic section of the image bearing member in the first embodiment of the present invention.

FIG. 1 is a schematic section of a typical image forming apparatus in accordance with the present invention.

The image forming apparatus in this embodiment is a laser beam printer (recording apparatus) which employs a transfer-type electrophotographic image formation process, a direct charging system, and a toner-recycling process (cleanerless system).

(1) General structure of printer

A reference character 1 designates a photosensitive member (negatively chargeable) as an image bearing member. The photosensitive member 1 is in the form of a cylindrical drum, and comprises an organic photoconductor. It has a diameter of 30 mm, and is rotatively driven in the clockwise direction indicated by an arrow mark, at a peripheral velocity (process speed) of 50 mm/sec.

Designated by a reference character 2 is an electrically conductive elastic roller (hereinafter, "charge roller") as a contact-type charging member.

The intermediary resistance layer 2*b* is composed of resin (for example, urethane), electrically conductive particles (for example, carbon black), sulfurizing agent, foaming agent, etc., and is laid on the peripheral surface of the metallic core 2*a* to form a roller along with the metallic core 2*a*. After being laid on the metallic core 2*a,* the surface of the medium resistance layer 2*b* is polished, if necessary, to obtain the charge roller 2, that is, an electrically conductive elastic roller measuring 12 mm in diameter and 250 mm in length.

The measured electrical resistance of the charge roller 2 in this embodiment was 100 KΩ. More specifically, the resistance of the charge roller 2 was measured in the following manner. The charge roller 2 was placed in contact with an aluminum drum with a diameter of 30 mm, so that the metallic core 2*a* of the charge roller 2 was subjected to an overall of 1 kg, and then, the resistance of the charge roller 2 was measured while applying 100 V between the metallic core 2*a* and the aluminum drum.

In this embodiment, it is important that the charge roller 2, which is an electrically conductive elastic roller, functions as an electrode. In other words, the charger roller 2 must be able to create a desirable state of contact between the charge roller 2 and the object to be charged, and also its electrical resistance is desired to be sufficiently low to charge a moving object. On the other hand, it needs to prevent voltage from leaking through the defective portions, for example, pin holes, of an object to be charged, just in case such defeats exist. Therefore, when the object to be charged is an electrophotographic photosensitive member, the electrical resistance of the charge roller 2 needs to be in a range of $10^4$–$10^7$ Ω so that satisfactory charging performance and leak resistance is realized.

As for the hardness of the charge roller 2, if it is too low, the shape of the charge roller 2 becomes too unstable to maintain the desirable state of contact between the charge roller 2 and the object to be charged. If it is too high, the charge roller 2 fails to form a desirable charging nip between itself and the object to be charged, and also the state of contact between the charge roller 2 and the object to be charged, within the charging nip becomes inferior in terms of a microscopic level. Therefore, the desirable hardness range for the charge roller 2 is 25–50 degree in the Asker-C scale.

The material for the charge roller 2 is not limited to the elastic foamed material described above. In addition to the material described above, it is possible to use EPDM, urethane, NBR, silicone rubber IR, and the like, in which electrically conductive particles such as carbon black or metallic oxide particles have been dispersed, and the foamed version of the same materials. It should be noted here that the resistance of the materials may be adjusted with the use of ion conductive material, instead of dispersing the electrically conductive particles.

The charge roller 2 is placed in contact with the photosensitive member 1 as an object to be charged, being pressed against its own elasticity, with a predetermined contact pressure. In FIG. 1, a referential character n designates a contact nip between the photosensitive member 1 and the charge roller 2, that is, the charging nip. The width of this charging nip is 3 mm. In this embodiment, the charge roller 2 is rotatively driven in the clockwise direction indicated by an arrow mark at approximately 80 rpm, so that the peripheral surfaces of the charge roller 2 and the photosensitive member 1 move at the same velocity in the opposite directions in the charging nip n. In other words, the charge roller 2 and the photosensitive member 1 are driven so that there exists a peripheral velocity difference between the surface of the charge roller 2 as the contact-type charging member, and the surface of the photosensitive member 1 as the object to be charged.

To the metallic core 2*a* of the charge roller 2, a DC voltage of −700 V is applied as the charge bias from a charge bias application power source S1. In this embodiment, the peripheral surface of the photosensitive member 1 is uniformly charged to a potential level (−680 V), which is substantially equal to the level of the voltage applied to the charge roller 2, through a direct charging system. This process will be described later in detail.

Designated by a referential character 3 is a laser beam scanner (exposing device) which comprises a laser diode, a polygon mirror, and the like. This laser beam scanner outputs a scanning beam of laser light L, the intensity of which is modulated with serial digital electric signals generated by digitizing the optical information of a target image, and which scans, or exposes, the uniformly charged peripheral surface of the photosensitive member 1. As a result, an electrostatic latent image corresponding to the optical information of the target image is formed on the peripheral surface of the cylindrical photosensitive member 1.

A reference character 4 designates a developing apparatus. The electrostatic latent image on the peripheral surface of the cylindrical photosensitive member 1 is developed into a toner image by this developing apparatus. This developing apparatus 4 is a reversal type apparatus which employs a single component dielectric toner (negative toner). Designated by a referential character 4*a* is a nonmagnetic development sleeve as a developer carrying member, which encases a magnet 4*b*. The negative toner 4*d* is coated on this development sleeve 4*a* by a regulator blade 4*c,* forming a thin layer. While the developer 4*d* is coated on the development sleeve 4*a* by the regulator blade 4*c,* the toner particles in the developer 4*d* are charged. As the sleeve 4*a* further rotates, the developer coated on the cylindrical development sleeve 4*a* is carried to a development area (development station), in which the distance between the peripheral surfaces of the photosensitive member 1 and the sleeve 4*a* is smallest. To the development sleeve 6*a,* a development bias is applied from a development bias application power source S2. The development bias is a compound voltage composed of a DC voltage of −500 V, and an AC voltage with a frequency of 1800 Hz, a peak-to-peak voltage of 1600 Hz, and a rectangular waveform. As the development bias is applied to the development sleeve 4*a,* the electrostatic latent image on the photosensitive member 1 is developed by the toner.

The developer 4*d* is a mixture of toner t and charge facilitator particles m (charge assisting particles). The toner t is composed of binder resin, magnetic particles, charge controller agent, formed through mixing, pulverizing, and classifying steps. To the thus composed toner, charge facilitator particles m and fluidizing agent are added to conduct the developer 4*d*. The weight average diameter (D4) of the toner t is 7 $\mu$m. The charge facilitator particles m employed in this embodiment are electrically conductive zinc oxide particles with an average diameter of 3 $\mu$m. The mixing ratio between the toner t and the charge facilitator particles is 100 weight parts to 2 weight parts.

In this embodiment, electrically conductive zinc oxide particles are used as the charge facilitator particles m. The average particle diameter of the particles, is 3 $\mu$m, and their specific resistivity is $10^6$ ohm.cm.

As for the material for the charge facilitator particles m, many other electrically conductive particles are usable; for example, metallic oxides other than the zinc oxide mentioned above, and a mixture of electrically conductive particles and organic materials.

The specific resistance of the charge facilitator particles m is desired to be no more than $10^{12}$ ohm.cm, and preferably, no more than $10^{10}$ ohm.cm, since electrical charge is given or received through the charge facilitator particles m.

The specific resistance of the charge facilitator particles m is obtained using a tablet method. That is, first, a cylinder which measures 2.26 $cm^2$ in bottom area size is prepared. Then 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

In order to uniformly charge an object, the average diameter of the charge facilitator particles m is desired to be no more than 50 $\mu$m. However, 10 nm is the bottom limit, in consideration of the stability of the charge facilitator particles m.

When the charge facilitator particle m is in the form of a granule, the diameter of the granule is defined as the average diameter of charge facilitator granules.

The diameter of the charge facilitator granule is determined based on the following method. First, 100 or more granules are picked with the use of an optical or electron microscope, and their maximum chord lengths in the horizontal direction are measured. Then, the volumetric particle distribution is calculated from the result of the measurement. Based on this distribution, a 50% average granule diameter is calculated to be used as the average granule diameter of the charge facilitator granules.

As described above, the charge facilitator particles m are in the primary state, that is, a powdery state, as well as in the secondary state, that is, a granular state. Neither state creates a problem. Whether the charge facilitator is in the powdery state or in the granular state, the state of the charge facilitator does not matter as long as it can function as the charge facilitator.

The charge facilitator particles m are desired to be colorless and transparent particles or virtually colorless and transparent particles so that they do not become an obstruction when they are used to facilitate the process in which a photosensitive member 1 is exposed to form latent image. This is rather important in consideration of the fact that the charge facilitator particles m might transfer from the photosensitive member 1 onto a recording sheet P when an image is recorded in color. Further, in order to prevent an exposure beam from being scattered by the charge facilitator particles while the photosensitive member 1 is exposed, the sizes the charge facilitator particles should be smaller than the picture element size. Further, the charge facilitator particles m are desired to be nonmagnetic.

Designated by a referential character 5 is a transfer roller with intermediary electrical resistance. It forms a transfer nip b at a point at which it is pressed against the peripheral surface of the photosensitive member 1, with a predetermined pressure. Into this transfer nip b, a sheet of recording medium, or a transfer sheet P, which is delivered from an unillustrated sheet feeder portion, is fed while a transfer bias with a predetermined voltage level is being applied to the transfer roller 5 from a transfer bias application power source S3. As a result, the toner image on the photosensitive member 1 side is transferred, sequentially from one end to the other, onto the surface of the transfer sheet P fed into the transfer nip b. In this embodiment, the electrical resistance of the transfer roller 5 is $5\times10^8$ ohm, and the toner image is transferred by applying a DC voltage of +2000 V to the transfer roller 5. During image transfer, the transfer sheet P is guided into the transfer nip b, and the toner image which has been formed and held on the peripheral surface of the photosensitive member 1 is transferred, sequentially from one end of the image to the other, onto the top side of the transfer sheet P by the electrostatic force and the nip pressure, while the transfer sheet P is conveyed through the transfer nip b, being pinched by the transfer roller 5 and the photosensitive member 1.

Designated by a referential character 6 is a fixing apparatus. After being fed into the transfer nip b and receiving the toner image transferred from the photosensitive member 1 side, the transfer sheet P is separated from the peripheral surface of the cylindrical photosensitive member 1, and then is guided into the fixing apparatus 6, in which the toner image is permanently fixed to the transfer sheet P. Thereafter, the transfer sheet P is discharged from the apparatus as a print or a copy.

The printer in this embodiment is of a cleanerless type. Thus, the residual toner, or the toner which remains on the peripheral surface of the cylindrical photosensitive member 1 after a toner image is transferred onto a transfer sheet P, is not removed by a cleaner, but instead, is carried to the location of the charge roller 2, or the charging nip. In the charging nip, the peripheral surface of the photosensitive member 1, on which the residual toner is present, is charged. Then, as the photosensitive member 1 is further rotated, a latent image is formed on the peripheral surface of the photosensitive member 1, which is still carrying the residual toner after being charged. As the photosensitive member 1 is further rotated, the residual toner is carried to the development station a, in which the residual toner is removed (recovered) by the developing apparatus at the same time as the electrostatic latent image is developed. In other words, at the same time as a cleaning electric field, which transfers the residual toner from the dark areas of the photosensitive member 1 to the development sleeve 6*b,* is formed, an electric field which adheres the toner from the development sleeve 6*b* to the light areas of the photosensitive member 1 is formed.

(2) Direct charging of photosensitive member 1 a) The electrically conductive charge facilitator particles m, contained in the developer 4*d* in the developing apparatus 4, transfer, by a proper amount, to the photosensitive member 1 as the electrostatic latent image on the photosensitive member 1 is developed by the developing apparatus 4 with the use of toner.

In the transfer nip b, the toner image on the photosensitive member 1 is affected, that is, attracted toward the transfer sheet P, by the transfer bias, and aggressively transfers onto a transfer sheet P, but the charge facilitator particles m on the photosensitive member 1 do not aggressively transfer onto the transfer sheet P, and remain on the peripheral surface of the photosensitive member 1, being practically adhered thereto, since they are electrically conductive. Moreover, the presence of the charge facilitator particles m, which are remaining on the peripheral surface of the photosensitive member l, being practically adhered thereto, is effective to improve the efficiency with which the toner image is transferred from the photosensitive member 1 side to the transfer sheet P side.

In the case of the image forming apparatus in this embodiment, which employs a toner recycling process, in other words, which does not employ a cleaner, the toner and the charge facilitator particles m, which remain on the peripheral surface of the photosensitive member 1 after image transfer, are simply carried, by the rotation of the photosensitive member 1, to the charging nip n, that is, the interface between the photosensitive member 1 and the charge roller 2 as a contact-type charging member, and then adhere to the charge roller 2.

Therefore, the photosensitive member 1 is directly charged with the presence of charge facilitator particles m at the interface between the photosensitive member 1 and the charge roller 2. It should be noted here that when the charge roller 2 is used for the first time, its peripheral surface is not supplied with the charge facilitator particles, and therefore, the peripheral surface of the charge roller 2 is coated with the charge facilitator particles in advance of the starting of a printing operation.

With the presence of the charge facilitator particles, even if toner enters the charging nip and adheres to the charge roller 2, the desirable state of contact is maintained between the charge roller 2 and the photosensitive member 1, in the terms of physical gaps and electrical resistance. Therefore, the photosensitive member 1 is directly and desirably charged by the charge roller, in spite of the contamination of the charge roller 2 with the residual toner, and even though the contact-type charging member is constituted of a simple member, such as the charge roller 2.

In other words, the charge roller 2 is allowed to be desirably in contact with the photosensitive member 1 in electrical terms, through the charge facilitator particles m, in the charging nip n. More specifically, the charge facilitator particles m present in the charging nip n, that is, the contact nip between the charge roller 2 and the photosensitive member 1, rub the peripheral surface of the photosensitive member 1, leaving thereby no gap between the charge roller 2 and photosensitive member 1. Thus, charge is truly directly injected into the photosensitive member 1; the presence of the charge facilitator particles m renders dominant, the direct charge mechanism (charge injection), which does not rely on electrical discharge, and therefore, is reliable and safe, in charging the photosensitive member 1 with the use of the charge roller 2. Thus, according to this embodiment, a high level of efficiency in terms of charging a photosensitive member, which was impossible to realize with the use of a charge roller prior to the present invention, can be realized; the photosensitive member 1 is charged to a potential level substantially equivalent to the level of the voltage applied to the charge roller 2.

The toner which remains on the photosensitive member 1 and adheres to the charge roller 2 is gradually ejected from the charge roller 2 onto the photosensitive member 1, is carried to the development section a as the photosensitive member 1 rotates, and then, is recovered (cleaned) by the developing apparatus 4 at the same time as a latent image is developed, in the development station a.

Naturally, a certain amount of the charge facilitator particles m which adhere to the charge roller 2 fall from the charge roller 2. However, as long as the image forming apparatus is in operation, the charge facilitator particles m contained in the developer 4*d* in the developing apparatus 4 keep on transferring onto the peripheral surface of the photosensitive member 1, in the development station a, are carried to the transfer nip b and then to the charging nip n as the photosensitive member 1 rotates, and are transferred onto the charge roller 2. Therefore, the presence of the charge facilitator particles m in the charging in n is assured to desirably charge the photosensitive member 1.

Thus, according to this embodiment, it is possible to provide an image forming apparatus which is based on a contact-type charging system, a transfer system, and a toner recycling process, is simple in structure yet durable and reliable, is low in cost, uses relatively low voltage to charge the photosensitive member, generates substantially no ozone, and therefore suffers from none of the ozone related problems, such as insufficient charging of the photosensitive member, and yet is capable of directly and desirably charging the image bearing member thereof, in spite of the contamination of the charge roller 2 with the toner which remains on the photosensitive member 1 after image transfer.

b) It is assured, with the use of a simple and yet effective means, that the charge facilitator particles m are always present at the interface between the charge roller 2 and the photosensitive member 1, and therefore, the charge roller 2 and the photosensitive member 1 are allowed to have a difference in peripheral velocity, due to the lubricative effect (friction reducing effect) of the charge facilitator particles m.

Since the charge roller 2 and the photosensitive drum 1 are allowed to rotate virtually in contact with each other at different peripheral velocities, the frequency at which the charge facilitator particles m come in contact with a given spot of the peripheral surface of the photosensitive member 1, at the interface between the charge roller 2 and the photosensitive member 1, is drastically improved; in other words, the highly desirable state of the contact is realized between the charge roller 2 and the photosensitive member 1. Therefore, the photosensitive member 1 is easily and truly directly charged.

As for the structure which affords the charge roller 2 a difference in peripheral velocity from the photosensitive member 1, the charge roller 2 is desired to be rotated in such a direction that makes the peripheral surfaces of the charge roller 2 and the photosensitive member 1 move in the opposite direction at their interface, so that the residual toner, that is, the toner which remains on the photosensitive member 1 after image transfer and is carried to the charging nip n, is temporarily transferred onto the charger roller 2. With this arrangement in place, the photosensitive member 1 is charged after the residual toner on the photosensitive member 1 is temporarily removed from the photosensitive member 1, and therefore, the photosensitive member 1 is more efficiently charged.

If the amount of the charge facilitator particles m between the photosensitive member 1 as an image bearing member, and the charge roller 2 as a contact-type charging member, in the charging nip n, is extremely small, the lubricative effect from the charge facilitator particles m is not sufficient. As a result, friction between the charge roller 2 and the photosensitive member 1 remains relatively large, which makes it hard for the charge roller 2 and the photosensitive member 1 to rotate while maintaining a peripheral velocity difference between them. In other words, it takes too much torque to drive them. In addition, if they are forcefully rotated against considerable friction, their peripheral surfaces are shaved. Further, the extremely small amount of the charge facilitator particles m fails to sufficiently improve the state of contact between the charge roller 2 and the photosensitive member 1, and therefore, the improvement in the charging performance of the apparatus is not sufficient. On the other hand, if the amount of the charge facilitator particles m between the charge roller 2 and the photosensitive member 1 is extremely large, too many charge facilitator particles m fall off from the charge roller 2, which sometimes has detrimental effects on image formation.

According to tests, the amount of the charge facilitator particles m between the charge roller 2 and the photosensitive member 1 is desired to be no less than $10^3$ particle/mm$^2$. If it is less than $10^3$ particle/mm$^2$, the lubricative effect, and the improvement in the state of contact between the charge roller 2 and the photosensitive member 1, are not sufficient, and therefore, the improvement in the charging performance is not as much as expected.

The more desirable amount is in a range of $10^3$–$5\times10^5$ particle/mm$^2$. If the amount of the charge facilitator particles m exceeds $5\times10^5$ particle/mm$^2$, the amount of the charge facilitator particles m which separate from the charge roller 2 and move to the photosensitive member 1 increases, preventing thereby the photosensitive member I from being sufficiently exposed regardless of the transmittance of the charge facilitator particles m themselves. If it is below $5\times10^5$ particle/cm$^2$, the amount of the charge facilitator particles m which depart from the photosensitive member 1 becomes moderate, and therefore, the harmful effect of the charge facilitator particles m is minimized. When the amount of the charge facilitator particles m which transferred onto the photosensitive member 1, while keeping the amount of the charge facilitator particles m between the charge roller 2 and the photosensitive member 1 in the above-mentioned more desirable range, was measured, it was within a range of $10^2$–$10^5$ particle/cm$^2$, which proves that the desirable amount of the charge facilitator particles m placeable between the charge roller 2 and the photosensitive member 1 without harmfully affecting image formation is no more than $10^5$ particle/cm$^2$.

Next, the method used for measuring the amount of the charge facilitator particles m between the charge roller 2 and the photosensitive member 1, and the amount of the charge facilitator particles m on the photosensitive member 1, will be described. It is desirable that the amount of the charge facilitator particles m between the charge roller 2 and the photosensitive member 1 is directly measured in the charging nip n between the charge roller 2 and the photosensitive member 1. However, most of the charge facilitator particles m which are already on the photosensitive member 1 are stripped away by the charge roller 2 which rotates in contact with the photosensitive member 1, in the direction opposite to the rotational direction of the photosensitive member 1, and therefore, the amount of the charge facilitator particles on the charge roller 2 measured immediately before the charging nip n is substituted for the actual amount of the charge facilitator particles between the charge roller 2 and the photosensitive member 1. More specifically, the rotation of the photosensitive member 1 and charge roller 2 is stopped, and the peripheral surfaces of the photosensitive member 1 and charge roller 2 is stopped, and the peripheral surfaces of the photosensitive member 1 and the charge roller 2 are photographed by a video-microscope (product of Olympus: OVM1000N) and a digital still recorder (product of Deltis: SR-3100), without applying the charge bias. In photographing the peripheral surface of the charge roller 2, the charge roller 2 is pressed against a piece of slide glass under the same condition as the charge roller 2 is pressed against the photosensitive member 1, and no less than 10 spots in the interface between the charge roller 2 and the slide glass were photographed with the use of the video-microscope fitted with an object lens with a magnification power of 1000. The thus obtained digital images are digitally processed using a predetermined threshold. Then, the number of the cells in which charge facilitator particles are present is calculated with the use of designated image processing software. As for the amount of the charge facilitator particles on the photosensitive member 1, the peripheral surface of the photosensitive member 1 is photographed using the same video-microscope, and then, the obtained images are processed in the same manner to obtain the number of the charge facilitator particles on the photosensitive member 1.

In this embodiment, the amount of the charge facilitator particles to be maintained at the interface between the charge roller 2 and the photosensitive member 1 is adjusted by adjusting the ratio of the charge facilitator particles m relative to the developer 4*d* in the developing apparatus 4, within a range of 0.01 to 20 parts in weight of the charge facilitator particles m per 100 parts in weight of toner t.

Figure 2:
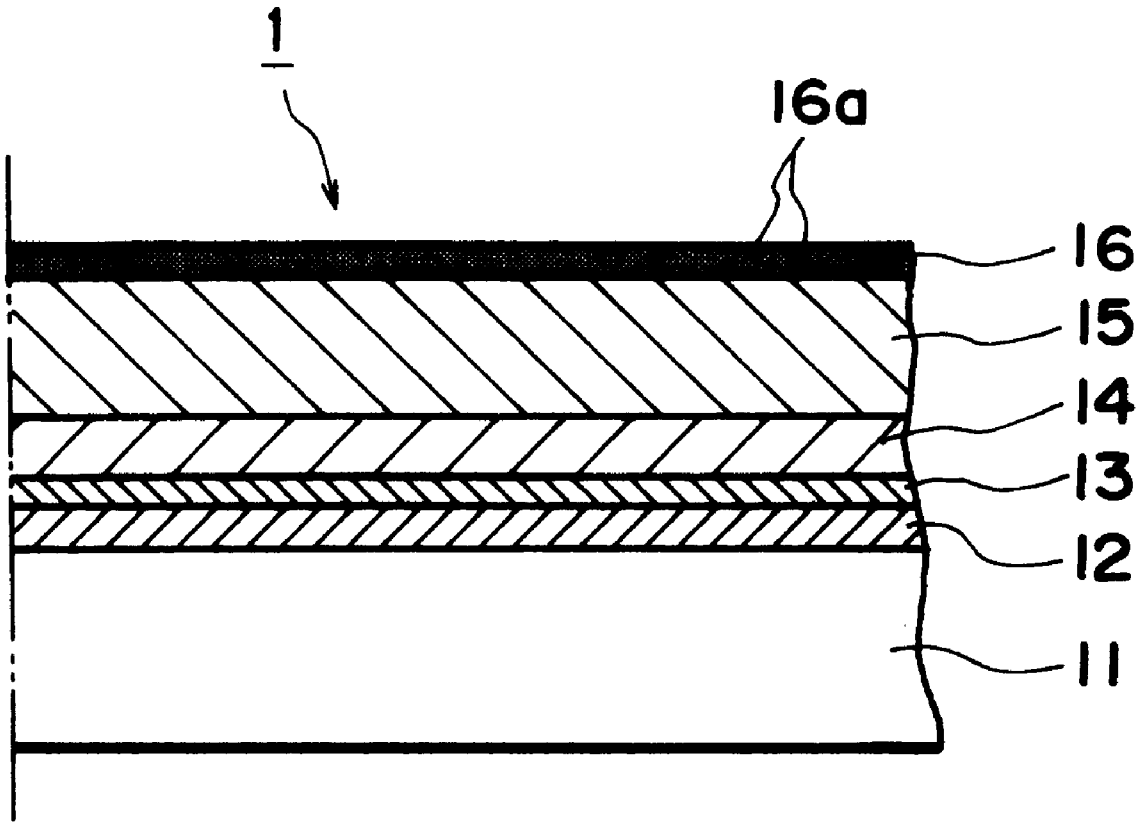
FIG. 2 is an enlarged schematic section of the peripheral surface portion of the photosensitive member in the second embodiment, in which the outermost layer of the photosensitive member is constituted of a charge injection layer.
Figure 3:
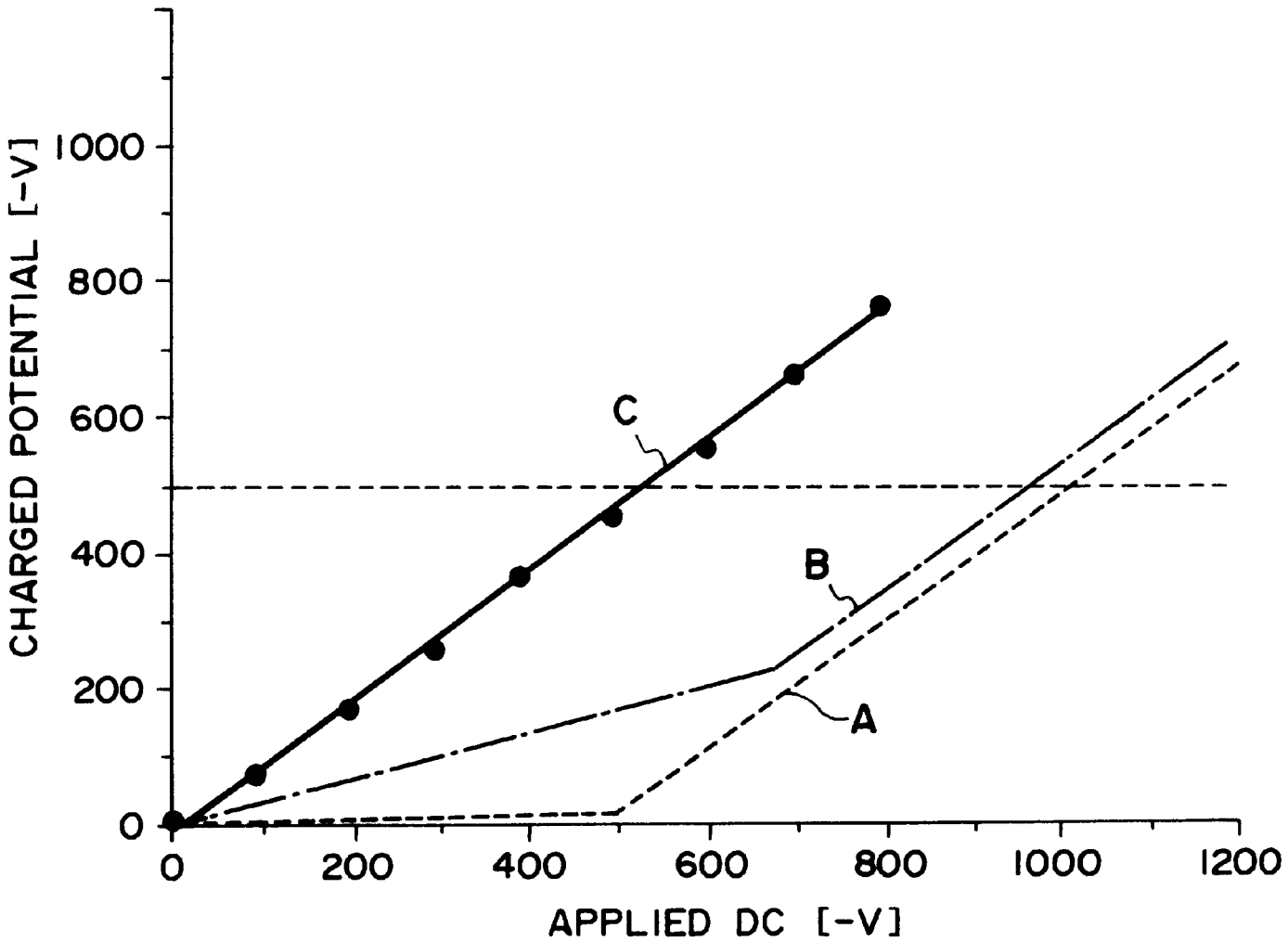
FIG. 3 is a graph which depicts the relationship between the DC voltage applied to a contact-type charging member and the potential level of the photosensitive member corresponding to the applied DC voltage.

Embodiment 2 (FIG. 2)

This embodiment is similar to the first embodiment, except that the photosensitive member 1, that is, the image bearing member, of an image forming apparatus is adjusted in surface resistance so that the photosensitive member is more reliably and more uniformly charged.

More specifically, the electrical resistance of the surface layer of the photosensitive member 1 is reduced so that even if the actual size, that is, the size at a microscopic level, of the interface between the contact-type charging member and the photosensitive member 1 is reduced due to the adhesion of the residual toner to the contact-type charging member, the peripheral surface of the photosensitive member 1 is desirably charged as it enters the latent image formation zone.

In this embodiment, the electrical resistance at the surface portion of the photosensitive member 1 is adjusted by provided the photosensitive member 1 with a charge injection layer, which constitutes the outermost layer of the photosensitive member 1. FIG. 2 is an enlarged schematic section of a portion of the photosensitive member 1 provided with the charge injection layer employed in this embodiment, and depicts the laminar structure of the photosensitive member 1. In this embodiment, the photosensitive member 1 is formed by coating a charge injection layer 16 on the peripheral surface of an ordinary photosensitive member, which is constituted of an aluminum drum 11 (base member), and various layers: an undercoat layer 12, a positive charge injection prevention layer 13, a charge generation layer 14, and a charge transfer layer 15, which are coated on the aluminum drum 11 in this order from the bottom. The charge injection layer 16 is coated to improve the photosensitive member 1 in terms of chargeability.

The charge injection layer 16 is composed of binder, electrically conductive particles 16*a* (electrically conductive filler), lubricant, polymerization initiator, and the like. The binder is photocurable acrylic resin, and the electrically conductive particles 16*a* are ultramicroscopic particles of $SnO_2$ (0.03 $\mu$m in diameter). The lubricant is tetrafluoroethylene (Teflon). The filler, lubricant, polymerization initiator, and the like are mixedly dispersed in the binder. Then, the mixture is coated on an ordinary photosensitive member, and is photocured.

The most important property of the charge injection layer 16 is its electrical resistance. In the case of a method for charging an object by directly injecting charge into the object, the efficiency with which an object is charged is improved by reducing the electrical resistance on the side of the object to be charged. Further, when the object to be charged is an image bearing member (photosensitive member), an electrostatic latent image must be retained for a certain length of time. Therefore, the proper range for the volumetric resistivity of the charge injection layer 16 is $1\times10^{9}$–$1\times10^{14}$ (ohm.cm).

It should be noted here that even if a photosensitive member lacks a charge injection layer 16 such as the one described in this embodiment, an effect equivalent to the effect generated by the charge injection layer 16 in this embodiment can be generated if the volumetric resistivity of the charge transfer layer 15, for example, is within the above described range.

Further, an effect similar to the effect described in this embodiment can be obtained by an amorphous silicon based photosensitive member, the surface layer of which has a volumetric resistivity of an approximately $10^{13}$ (ohm.cm).

(Evaluation of preceding embodiments)

The superior characteristics of the present invention are summarized in Table 1, which also shows the characteristics of comparative examples.

TABLE 1

| | Charging (Ghost) | | |
|---|---|---|---|
| | Drum speed 50 mm/sec Charger speed 50 mm/sec | Drum speed 100 mm/sec Charger speed 100 mm/sec | Drum speed 100 mm/sec Charger speed 50 mm/sec |
| Comp. Ex. 1 | NG/— | NG/— | NG/— |
| Comp. Ex. 2 | E/NG | E/NG | G/NG |
| Emb. 1 | E/E | E/E | G/G |
| Emb. 2 | E/E | E/E | E/E |

COMPARATIVE EXAMPLE 1

A charge roller is employed as charging member, and is rotated by a photosensitive member. The charge facilitator particles m were not mixed in the developer 4*d;* in other words, the charge facilitator particles m were not employed.

COMPARATIVE EXAMPLE 2

It is substantially the same as the Comparative Example 2, except that the charge roller was coated with the charge facilitator particles (charge facilitator particles were not mixed in the developer 4*d*).

(Evaluation criterion)

The image recording apparatus were operated at different speeds, and the obtained prints were evaluated in terms of a ghost.

A ghost, here, means a ghostly unwanted image which appears in a print, across the area corresponding to the preceding rotation of the photosensitive member. The mechanism which creates a ghost is as follows. If there is an interference while a contact-type charging roller, that is, a charge roller in the cases of the preceding embodiments, is charging a photosensitive member, the portions of the peripheral surface of the photosensitive member, which have been exposed to intense light during the preceding rotation of the photosensitive member, are insufficiently charged, and since the image forming apparatuses in the tests were based on the reversal development system, the latent image formed during the following rotation of the photosensitive member is developed darker than it is supposed to be, across the areas corresponding to these insufficiently charged portions, causing a ghostly image to appear.

The criteria for image evaluation are as follows:

NG: A ghost is visible in white areas located on the immediate downstream side, relative to the direction in which an image is formed, of solid black areas.

G: A ghost is not visible in which areas located on the immediate downstream side of solid black areas, relative to the direction in which an image is formed, but is visible in intermediately tinted areas on the downstream side of solid black areas.

E: A ghost is not visible either in white areas or intermediately tinted areas on the downstream side of solid black areas.

Further, images were evaluated at the beginning and end of a printing operation in which 1000 prints were made. In the printing operation, printing sheets of A4 size were fed so that the longitudinal edge of a printing sheet became perpendicular to the direction in which they were fed. In the Table 1, the left and right sides of the slash represent the results at the beginning and the end, respectively.

The following are evident from the table.

In the case of Comparative Example 1, even the copies made at the beginning of the printing operation indicated that the photosensitive member was insufficiently charged. In other words, the state of contact between the contact-type charging member (charge roller) and the photosensitive member was not satisfactory for the contact-type charging member to directly charge the photosensitive member to a desirable potential level.

In the case of Comparative Example 2, in which the charge facilitator particles were coated once in advance on the charge roller, but were not mixed in the developer, a ghost was not visible at the beginning of the printing operation, but as the printing operation continued, the charge roller was quickly contaminated, losing the charge facilitator particles from its peripheral surface, and as a result, image quality became drastically inferior.

In the case of Embodiment 1, in which the charge facilitator particles m were mixed in the developer 4*d,* the charge roller is continuously supplied with the charge facilitator particles m at a constant rate by way of the photosensitive member. Therefore, the desirable state of contact in terms of the charging of the photosensitive drum was maintained between the charge roller and the photosensitive member. When the peripheral velocities of the photosensitive drum and the charge roller were both increased, the photosensitive member was desirably charged, but when the peripheral velocity of the charge roller was reduced, the photosensitive member was slightly insufficiently charged. This proves that the photosensitive member is more efficiently charged when the peripheral velocity of the charge roller is rendered different from that of the photosensitive member.

In the case of the Embodiment 2, in which the electrical resistance of the surface layer of the photosensitive member was lowered as much as possible within a range in which an electrostatic latent image could be maintained, electrical charge was more efficiently transferred from the charge roller to the photosensitive member even though the state of the contact between the charge roller and the photosensitive member was kept the same as in Embodiment 1. The evaluation of the images made at process speeds of 100 mm/sec and 50 mm/sec was G, no ghost was found, proving that Embodiment 2 is effective when a higher process speed is used.

Figure 4:
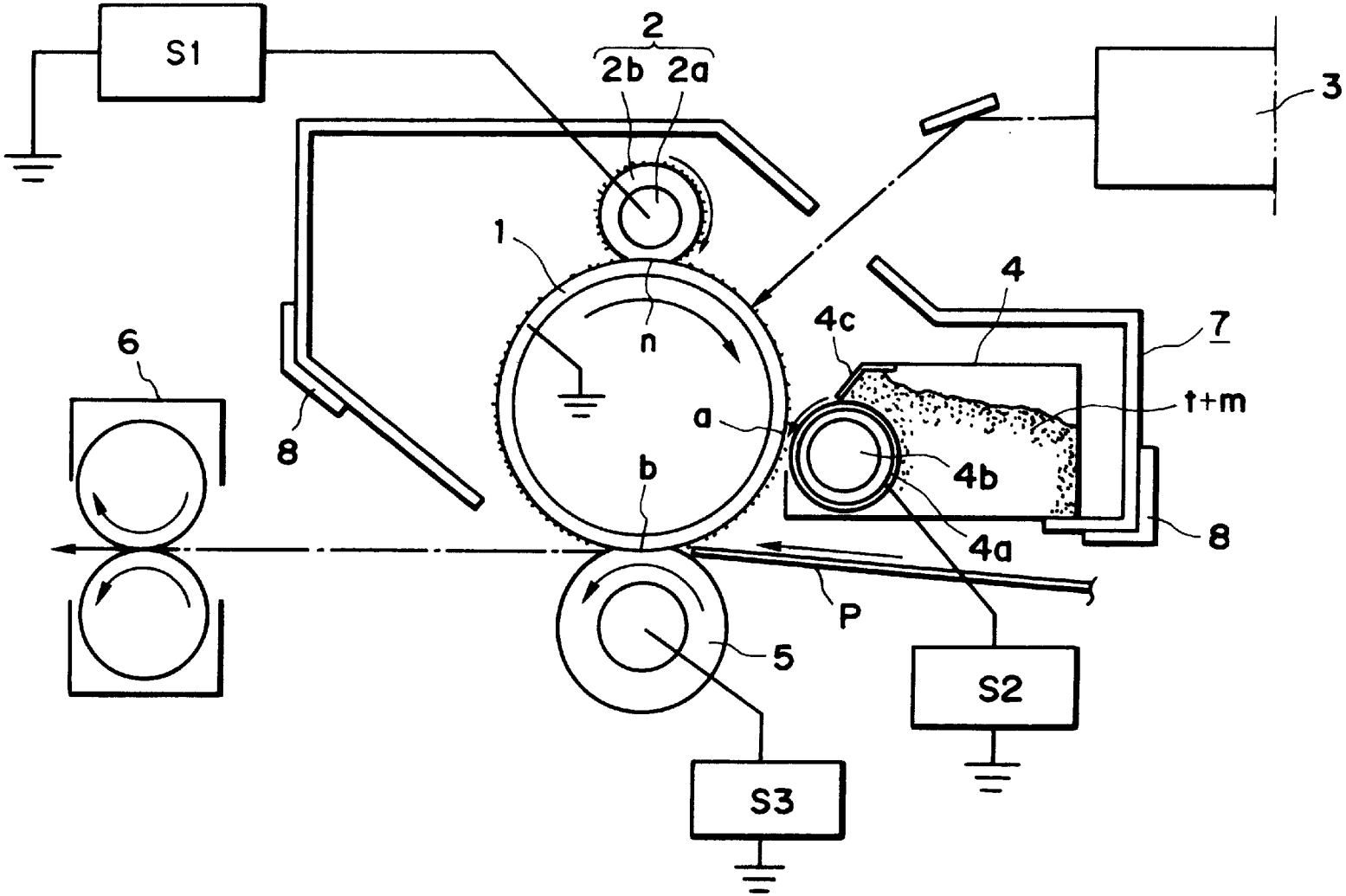
FIG. 4 is a schematic section of the image forming apparatus in the third embodiment of the present invention.

Embodiment 3 (FIG. 4)

FIG. 4 is a schematic section of a typical image forming apparatus in accordance with the present invention.

The image forming apparatus described in this embodiment is a laser beam printer (recording apparatus) which employs a transfer-type electrophotographic process, a direct charging system, and a toner recycling process (cleanerless system).

(1) General structure

A reference numeral 1 designates a photosensitive member as an image bearing member, which is an organic photoconductor type member (negatively chargeable photosensitive member). It is in the form of a cylindrical drum with a diameter of 30 mm, and is rotatively driven in clockwise direction indicated by an arrow mark at a peripheral velocity of 94 mm/sec (process speed).

Designated by a reference numeral 2 is an electrically conductive elastic roller (hereinafter, "charge roller").

The charge roller 2 is formed by covering the peripheral surface of a metallic core 2*a* with a layer 2*b* of foamed material with the intermediary electrical resistance. The material for the layer 2*b* is composed by mixing resin (for example, urethane) with electrically conductive particles (for example, carbon black), sulfurizing agent, foaming agent, and the like. After covering the metallic core 2*a,* the peripheral surface of the foamed layer 2*b* with intermediary electrical resistance is polished.

In this embodiment, it is important that the charge roller 2, which is an electrically conductive elastic roller, functions as an electrode. In other words, the charge roller 2 must be given sufficient elasticity for the charge roller to be able to create a desirable state of contact between the charge roller 2 and the object to be charged, that is, the photosensitive member, and also its electrical resistance is desired to be sufficiently low to charge the moving photosensitive member. On the other hand, it must be able to prevent voltage from leaking through the defective portions, for example, pin holes, of the photosensitive member, just in case such defects exist. Therefore, when the object to be charged is an electrophotographic photosensitive member, the electrical resistance of the charge roller 2 is desired to be in a range of $10^4$–$10^7$ Ω so that satisfactory charging performance and leak resistance is realized.

As for the hardness of the charge roller 2, if it is too low, the shape of the charge roller 2 becomes too unstable to maintain the desirable state of contact between the charge roller 2 and the object to be charged. If it is too high, the charge roller 2 fails to form a desirable charging nip between itself and the photosensitive member, and also the state of contact between the charge roller 2 and the photosensitive member, within the charging nip becomes inferior in terms of microscopic level. Therefore, the desirable hardness range for the charge roller 2 is 25–50 deg. in the Asker-C scale.

The material for the charge roller 2 is not limited to the elastic foamed material described above. In addition to the material described above, it is possible to use EPDM, urethane, NBR, silicone rubber, IR, and the like, in which electrically conductive particles such as carbon black or metallic oxide particles have been dispersed, and the foamed version of the same materials. It should be noted here that the resistances of the materials may be adjusted with the use of ion conductive material, instead of dispersing the electrically conductive particles.

The charge roller 2 is pressed on the photosensitive member 1, against its own elasticity, forming a nip n (charging nip) which is the interface between the photosensitive member 1 and the charge roller 2. In this embodiment the charge roller 2 is rotatively driven at a revolution of 100 rpm in the clockwise direction indicated by an arrow mark, so that the peripheral surfaces of the charge roller 2 and the photosensitive member 1 more in the opposite directions in the charging nip n. In other words, the charge roller 2 and the photosensitive member 1 are rotatively driven so that the peripheral surface of the charge roller 2 as a contact-type charging member moves at a velocity different, by 100%, from that of the photosensitive member 1 as an object to be charged.

To the metallic core 2*a* of the charge roller 2, −700 V of DC voltage is applied as a charge bias from a charge bias application power source S1. As a result, the peripheral surface of the photosensitive member 1 is uniformly charged, through the direct charging mechanism, to a potential level of −680 V, which is substantially equal to the voltage level of the charge bias applied to the charge roller 2. This process will be described later in detail.

Designated by a reference numeral 3 is a laser beam scanner (exposing device) which comprises a laser diode, a polygon mirror, and the like. This laser beam scanner outputs a scanning beam of laser light L, the intensity of which is modulated with serial digital electric signals generated by digitizing the optical information of a target image, and which scans, or exposes, the uniformly charged peripheral surface of the photosensitive member 1. As a result, an electrostatic latent image corresponding to the optical information of the target image is formed on the peripheral surface of the cylindrical photosensitive member 1.

A reference numeral 4 designates a developing apparatus. The electrostatic latent image on the peripheral surface of the cylindrical photosensitive member 1 is developed into a toner image by this developing apparatus.

This developing apparatus 4 is a reversal type apparatus which employs a single-component, negatively-chargeable dielectric toner (negative toner) with an average particle diameter of 7 μm, as developer.

Designated by a reference character 4*a* is a nonmagnetic development sleeve as a member for carrying the developer, which encases a magnet 4*b*. The diameter of the development sleeve 4*a* is 16 mm. The negative toner is coated on this development sleeve 4*a*, forming a thin layer and being electrically charged as it is regulated by an elastic blade 4*b*. The distance between the peripheral surfaces of the development sleeve 4*a* and the photosensitive member 1 is fixed at 500 μm. The development sleeve 4*a* is rotated so that its peripheral surface moves in the same direction, and at the same velocity, as the photosensitive member 1, in the development station a (development area) in which the distance between the charge roller 2 and photosensitive member 1 is smallest, and development bias is applied to the development sleeve 4*a* from a development bias application power source S2. The developer coated on the peripheral surface of the cylindrical charge roller 2 is carried to the development station a as the charge roller 2 is rotated. As for the development bias, a DC voltage of −400 V, and an AC voltage with a frequency of 1600 Hz, a peak-to-peak voltage of 1600 V, and a rectangular waveform, are superposingly applied to cause the toner to jump from the development sleeve 4*a* to the photosensitive member 1.

In the developer, that is, the toner t, the charge facilitator particles m (charging process aiding particles) are mixed. The charge facilitator particles m employed in this embodiment are electrically conductive zinc oxide particles, which have a specific resistivity of $1\times10^7$ ohm.cm and an average particle diameter of 2.5 μm. The ratio at which the charge facilitator particles m are mixed in the developer (toner) is 2–3 parts in weight relative to 100 parts in weight of developer.

The average particle diameter of the particles, inclusive of the secondary particles is 2.5 μm, and their specific resistivity is $10^7$ ohm.cm.

As for the material for the charge facilitator particles m, many other electrically conductive particles are usable; for example, metallic oxides other than the zinc oxide mentioned above, and mixture of electrically conductive particles and organic materials.

The specific resistance of the charge facilitator particles m is desired to be no more than $10^{12}$ ohm.cm, preferably, no more than $10^{10}$ ohm.cm, since electrical charge is given or received through the charge facilitator particles m. If the resistance value of the charge facilitator particles is greater than $1\times10^{12}$ ohm.cm, the charging performance of the charge roller declines. Therefore, the resistance value needs to be no more than $1\times10^{12}$ ohm.cm. In this embodiment, the resistance value of the charge facilitator particles is $1\times10^7$ ohm.cm.

The specific resistance of the charge facilitator particles m is obtained using a tablet method. That is, first, a cylinder which measures 2.26 $cm^2$ in bottom area size is prepared. Then, 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

In order to prevent the charge facilitator particles m from interfering with an exposing process, the charge facilitator particles m should be transparent or virtually transparent. Further, in consideration of the possibility that the charge facilitator particles m might transfer from the photosensitive member 1 to a transfer sheet P during a color printing operation, they are desired to be transparent or virtually transparent.

When the average particle diameter of the charge facilitator particles m was no less than approximately ½ of the average particle diameter of the toner t, that is, the developer, an exposing process was sometimes adversely affected by the charge facilitator particles m. Therefore, the average particle diameter of the charge facilitator particles m is made to be no more than half the average particle diameter of toner t.

When the charge facilitator particle m is in the form of a granule, the diameter of the granule is defined as the average diameter of charge facilitator granules.

The diameter of the charge facilitator granule is determined based on the following method. First, 100 or more granules are picked with the use of an optical or electron microscope, and their maximum chord lengths in the horizontal direction are measured. Then, their volumetric particle distribution is calculated from the result of the measurement. Based on this distribution, the 50% average granule diameter is calculated to be used as the average granule diameter of the charge facilitator granules.

As described above, the charge facilitator particles m are in the primary state, that is, a powdery state, as well as in the secondary state, that is, a granular state. Neither state creates a problem. Whether the charge facilitator is in the primary state or in the secondary granular state, the state of the charge facilitator does not matter as long as it can function as the charge facilitator.

Designated by a referential numeral 5 is a transfer roller with intermediary electrical resistance. It forms a transfer nip b at a point at which it is pressed against the peripheral surface of the photosensitive member 1, with a predetermined pressure. Into this transfer nip b, a sheet of a recording medium, or a transfer sheet P, which is delivered from an unillustrated sheet feeder portion, is fed while a transfer bias with a predetermined voltage level is being applied to the transfer roller 5 from a transfer bias application power source S3. As a result, the toner image on the photosensitive member 1 side is transferred, sequentially from one end to the other, onto the surface of the transfer sheet P fed into the transfer nip b. In this embodiment, the electrical resistance of the transfer roller 5 is $5\times10^8$ ohm, and the toner image is transferred by applying a DC voltage of +3000 V to the transfer roller 5. During image transfer, the transfer sheet P is guided into the transfer nip b, and the toner image which has been formed and held on the peripheral surface of the photosensitive member 1 is transferred, sequentially from one end of the image to the other, onto the top side of the transfer sheet P by the electrostatic force and the nip pressure, while the transfer sheet P is conveyed through the transfer nip b, being pinched by the transfer roller 5 and the photosensitive member 1.

Designated by a reference numeral 6 is a fixing apparatus. After being fed into the transfer nip b and receiving the toner image transferred from the photosensitive member 1 side, the transfer sheet P is separated from the peripheral surface of the cylindrical photosensitive member 1, and then is guided into the fixing apparatus 6, in which the toner image is permanently fixed to the transfer sheet P. Thereafter, the transfer sheet P is discharged from the apparatus as a print or a copy.

The printer in this embodiment is of a cleanerless type. Thus, the residual toner, or the toner which remains on the peripheral surface of the cylindrical photosensitive member 1 after a toner image is transferred onto a transfer sheet P, is not removed by a cleaner, but instead, as the photosensitive member 1 is further rotated, the residual toner is carried to the development station a, in which the residual toner is removed (recovered) by the developing apparatus 4 at the same time as the electrostatic latent image is developed (toner recycling process).

A reference numeral 7 designates a process cartridge which is replacably installable in the main assembly of a printer. The printer in this embodiment comprises a photosensitive member 1 and three processing devices: a photosensitive member 1, a charge roller 2, and a development apparatus 4. The photosensitive member 1 and the three devices are integrally disposed in a cartridge removably installable in the main assembly of a printer. The combination of the processing devices disposed in the process cartridge is not limited to the above-described one, as long as a photosensitive member 1 and at least one processing device are included. Reference numerals 8 and 8 designate guides which guide a process cartridge when the process cartridge is installed or removed, and which hold the process cartridge after the installation.

(2) Direct charging of photosensitive member 1 a)The electrically conductive charge facilitator particles m contained in the developer t in the developing apparatus 4 transfer, by a proper amount, to the photosensitive member 1 as the electrostatic latent image on the photosensitive member 1 is developed by the developing apparatus 4 with the use of toner.

In the transfer nip b, the toner image on the photosensitive member 1 is affected, that is, attracted toward the transfer sheet P, by the transfer bias, and aggressively transfers onto a transfer sheet P, but the charge facilitator particles m on the photosensitive member 1 do not aggressively transfer onto the transfer sheet P, and remain on the peripheral surface of the photosensitive member 1, being practically adhered thereto, since they are electrically conductive.

In the case of the image forming apparatus in this embodiment, which employs a toner recycling process, in other words, which does not employ a cleaner, the toner and the charge facilitator particles m, which remain on the peripheral surface of the photosensitive member 1 after image transfer, are simply carried, by the movement of the photosensitive member 1, to the charging station n, that is, the interface between the photosensitive member 1 and the charge roller 2 as a contact-type charging member, and then adhere to the charge roller 2.

Therefore, electrical charge is injected into the photosensitive member 1 with the presence of charge facilitator particles m at the interface between the photosensitive member 1 and the charge roller 2.

With the presence of the charge facilitator particles, even if toner enters the charging nip and adheres to the charge roller 2, the desirable state of contact is maintained between the charge roller 2 and the photosensitive member 1, in terms of physical gaps and electrical resistance. Therefore, electrical charge can be directly injected into the photosensitive member 1 by the charge roller 2.

In other words, the charge roller 2 is allowed to be desirably in contact with the photosensitive member 1 in electrical terms, through the charge facilitator particles m. More specifically, the charge facilitator particles m present in the contact nip between the charge roller 2 and the photosensitive member 1, rub the peripheral surface of the photosensitive member 1, leaving thereby no gap between the charge roller 2 and photosensitive member 1. Thus, charge is truly directly injected into the photosensitive member 1; the presence of the charge facilitator particles m renders dominant, the direct charge mechanism (charge injection), which does not rely on electrical discharge, and therefore, is reliable and safe, in charging the photosensitive member 1 with the use of the charge roller 2. Thus, according to this embodiment, a high level of efficiency in terms of charging a photosensitive member, which was impossible to realize with the use of a charge roller prior to the present invention, can be realized; the photosensitive member 1 is charged to a potential level substantially equivalent to the level of the voltage applied to the charge roller 2.

The toner which remains on the photosensitive member 1 and adheres t the charge roller 2 is gradually ejected from the charge roller 2 onto the photosensitive member 1, is carried to the development station as the peripheral surface of the photosensitive member 1 moves and then, is recovered (cleaned) by the developing means at the same time as a latent image is developed, in the development station.

Naturally, a certain amount of the charge facilitator particles m, which adhere to the charge roller 2, fall from the charge roller 2, or deteriorates. However, as long as the image forming apparatus is in operation, the charge facilitator particles m contained in the developer t in the developing apparatus 4 keep on transferring onto the peripheral surface of the photosensitive member 1, in the development station a, are carried to the transfer nip b and then to the charging nip n as the photosensitive member 1 rotates, and are transferred onto the charge roller 2. Therefore, the presence of the charge facilitator particles m in the charging nip n is assured to prevent the charging performance of the charge roller 2 from declining. As a result, the desirable charging performance is maintained.

Thus, according to this embodiment, it is possible to provide an image forming apparatus which is based on a contact-type charging system, a transfer system, and a toner recycling process, is simple in structure yet durable and reliable, is low in cost, uses relatively low voltage to charge the photosensitive member, generates substantially no ozone, and therefore suffers from none of the ozone related problems such as insufficient charging of the photosensitive member, and yet is capable of directly and desirably charging the image bearing member thereof, in spite of the contamination of the charge roller 2 by the toner which remains on the photosensitive member 1 after image transfer.

b) Further, as described before, in order for the charging facilitator particles m not to interfere with the charging performance of the charge roller 2, the electrical resistance value of the charge facilitator particles m needs to be no more than $1\times10^{12}$ ohm.cm. Therefore, in the case of a contact-type developing apparatus, the developer of which makes direct contact with the photosensitive member 1 in the development station a, charge is injected into the photosensitive member 1 by the development bias through the charge facilitator particles m in the developer. As a result, foggy images are produced.

However, the developing apparatus in this embodiment is of a noncontact type, and therefore, charge is not injected into the photosensitive member 1 by the development bias. Thus, desirable images can be produced. Further, since electrical charge is not injected into the photosensitive member 1 in the development station a, it is possible to provide a higher degree of bias, that is, a higher level of difference in terms of electrical potential, between the development sleeve 4*a* and the photosensitive member 1, by applying, for example, AC voltage. Therefore, the charge facilitator particles m are likely to be more uniformly developed, that is, the charge facilitator particles m are uniformly coated on the peripheral surface of the photosensitive member 1, creating a uniform, that is, desirable, state of contact between the charge roller 2 and the photosensitive member 1, in the charging station. As a result, the photosensitive member 1 is desirably charged to produce desirable images.

c) It is assured, with the use of a simple and yet effective means, that the charge facilitator particles m are always present at the interface n between the charge roller 2 and the photosensitive member 1, and therefore, the charge roller 2 and the photosensitive member 1 are allowed to have a difference in peripheral velocity, due to the lubricative effect (friction reducing effect) of the charge facilitator particles m.

Since the charge roller 2 and the photosensitive drum 1 are allowed to rotate virtually in contact with each other at different peripheral velocities, the frequency at which the charge facilitator particles m come in contact with a given spot of the peripheral surface of the photosensitive member 1, at the interface between the charge roller 2 and the photosensitive member 1, is drastically improved; in other words, the highly desirable state of the contact is realized between the charge roller 2 and the photosensitive member 1. Therefore, electrical charge is easily injected into the photosensitive member 1.

As for the structure which provides a peripheral velocity difference between the charge roller 2 and photosensitive member 1, the charge roller 2 may be rotatively driven or may be non-rotatively fixed. However, in order to temporarily transfer to the charge roller 2 the residual toner on the photosensitive member 1, which is carried into the charging nip n, the charge roller 2 is desired to be rotated in such a direction that makes the peripheral surfaces of the charge roller 2 and the photosensitive member 1 move in the opposite direction at their interface, so that the residual toner, that is, the toner which remains on the photosensitive member 1 after image transfer and is carried to the charging nip n, is temporarily transferred onto the charge roller 2. With this arrangement in place, the photosensitive member 1 is charged after the residual toner on the photosensitive member 1 is temporarily removed from the photosensitive member 1, and therefore, the photosensitive member 1 is efficiently charged.

If the amount of the charge facilitator particles m between the photosensitive member 1 as an image bearing member, and the charge roller 2 as a contact-type charging member, in the charging nip n, is extremely small, the lubricate effect from the charge facilitator particles m is not sufficient. As a result, the friction between the charge roller 2 and the photosensitive member 1 remains relatively large, which makes it hard for the charge roller 2 and the photosensitive member 1 to rotate while maintaining a peripheral velocity difference between them. In other words, it takes too much torque to drive them. In addition, if they are forcefully rotated against considerable friction, their peripheral surfaces are shaved. Further, the extremely small amount of the charge facilitator particles m fails to sufficiently improve the state of contact between the charge roller 2 and the photosensitive member 1, and therefore, the improvement in the charging performance of the apparatus is not sufficient. On the other hand, if the amount of the charge facilitator particles m between the charge roller 2 and the photosensitive member 1 is extremely large, too many charge facilitator particles m fall off from the charge roller 2, which sometimes has detrimental effects on image formation.

According to tests, the amount of the charge facilitator particles m between the charge roller 2 and the photosensitive member 1 is desired to be no less than $10^3$ particle/mm$^2$. If it is less than $10^3$ particle/mm$^2$, the lubricative effect, and the improvement in the state of contact between the charge roller 2 and the photosensitive member 1, are not sufficient, and therefore, the improvement in the charging performance is not as much as expected.

The more desirable amount is in a range of $10^3$–$5\times10^5$ particle/mm$^2$. If the amount of charge facilitator particles m exceeds $5\times10^5$ particle/mm$^2$, the amount of the charge facilitator particles m which separate from the charge roller 2 and move to the photosensitive member 1 increases, thereby preventing the photosensitive member 1 from being sufficiently exposed regardless of the transmittance of the charge facilitator particles m themselves. If it is below $5\times10^5$ particle/cm$^2$, the amount of the charge facilitator particles m which depart from the photosensitive member 1 becomes moderate, and therefore, the harmful effect of the charge facilitator particles m is minimized. When the amount of the charge facilitator particles m which transferred onto the photosensitive member 1, while keeping the amount of the charge facilitator particles m between the charge roller 2 and the photosensitive member 1 in the above mentioned more desirable range was measured, it was within a range of $10^2$–$10^5$ particle/cm$^2$, which proves that the desirable amount of the charge facilitator particles m placeable between the charge roller 2 and the photosensitive member 1 without harmfully affecting image formation is no more than $10^5$ particle/cm$^2$.

Next, the method used for measuring the amount of the charge facilitator particles m between the charge roller 2 and the photosensitive member 1, and the amount of the charge facilitator particles m on the photosensitive member 1, will be described. It is desirable that the amount of the charge facilitator particles m between the charge roller 2 and the photosensitive member 1 is directly measured in the charging nip n between the charge roller 2 and the photosensitive member 1. However, most of the charge facilitator particles m which are already on the photosensitive member 1 are stripped away by the charge roller 2 which rotates in contact with the photosensitive member 1, in the direction opposite to the rotational direction of the photosensitive member 1, and therefore, the amount of the charge facilitator particles on the charge roller 2 measured immediately before the charging nip n is substituted for the actual amount of the charge facilitator particles between the charge roller 2 and the photosensitive member 1. More specifically, the rotation of the photosensitive member 1 and charge roller 2 is stopped, and the peripheral surfaces of the photosensitive member 1 and the charge roller 2 are photographed by a video-microscope (product of Olympus: OVM1000N) and a digital still recorder (product of Deltis: SR-3100), without applying the charge bias. In photographing the peripheral surface of the charge roller 2, the charge roller 2 is pressed against a piece of slide glass under the same condition as the charge roller 2 is pressed against the photosensitive member 1, and no less than 10 spots in the interface between the charge roller 2 and the slide glass were photographed with the use of the video-microscope fitted with an object lens with a magnification power of 1000. The thus obtained digital images are digitally processed using a predetermined threshold. Then, the number of cells in which charge facilitator particles are present is calculated with the use of a designated image processing software. As for the amount of the charge facilitator particles on the photosensitive member 1, the peripheral surface of the photosensitive member 1 is photographed using the same video-microscope, and then, the obtained images are processed in the same manner to obtain the number of the charge facilitator particles on the photosensitive member 1.

In this embodiment, the amount of the charge facilitator particles to be maintained at the interface between the charge roller 2 and the photosensitive member 1 is adjusted by adjusting the ratio of the charge facilitator particles m relative to the developer 4*d* in the developing apparatus 4, within a range of 0.01 to 20 parts in weight of the charge facilitator particles m per 100 parts in weight of toner t.

(3) Evaluation of Embodiment 3

Advantages of this embodiment are summarized in the following, along with the evaluations of the other embodiments.

| | Item 1 | Item 2 |
|---|---|---|
| Embodiment 3 | G | G |
| Embodiment 4 (application of DC bias) | F | G |
| Embodiment 5 (superposition of AC bias) | G | NG |

Embodiments 4 and 5

These embodiments are the same as Embodiment 3, except that a contact-type developing apparatus, which has a distance of 100 $\mu$m between the development sleeve 4*a* and the photosensitive member 1, is employed in place of the developing apparatus 4 employed in Embodiment 3.

In Embodiment 4, the development bias is provided by the application of a DC voltage of −420 V. In Embodiment 5, the development bias is provided by the application of a compound voltage composed of a DC voltage of −420 V and an AC voltage with a frequency of 1600 Hz, a peak-to-peak voltage of 1600 V, and a rectangular waveform. Otherwise, the printer structure is the same as that in Embodiment 3.

Embodiment 3 was compared with Embodiments 4 and 5 in terms of produced images. The criteria for image comparison are as follows.

Item 1: presence of ghost in solid white areas or intermediately tinted areas on the downstream side of solid black area.

Item 2: presence of fog in solid white area.

Item 1 is a criterion which reflects the performance in charging, and Item 2 is a criterion which reflects the performance in development.

As for the evaluation of images, 500 A4 size prints, which were produced by feeding A4 size sheets in the direction which makes the long edges of the sheets perpendicular to the feeding direction, were evaluated. Given below are the criteria:

For Item 1:

G: No ghost in intermediately tinted areas on the downstream side of solid black areas.

F: No ghost in white areas, but ghost in intermediately tinted areas on the downstream side of solid black areas.

NG: Ghost in solid white areas and intermediately tinted areas on the downstream side of solid black areas.

As for the evaluation in terms of Item 2, the charging apparatus was switched to an electrical-discharge-type apparatus, which employed a charge roller, and the prints were examined for fogginess of the solid white areas:

G: No fog

F: Slight fog

NG: Apparent fog

When the development bias was created by applying only a DC voltage as in Embodiment 4, the peripheral surface of the photosensitive member 1 was not supplied with a sufficient amount of the charge facilitator particles m mixed in the developer, causing the photosensitive member 1 to be charged to a potential level slightly below the desirable level as the printing continued. As a result, image quality deteriorated as shown by the Item 1 column in the table.

When the development bias was created by a compound voltage composed of a DC voltage and an AC voltage as in Embodiment 5, a sufficient amount of the charge facilitator particles m was supplied, but electrical charge was injected into the peripheral surface of the photosensitive member 1, causing fog to appear.

On the other hand, in the case of Embodiment 3, a phenomenon which occurred in the cases of Embodiment 5 did not occur; the peripheral surface of the photosensitive member 1 was supplied with a proper amount of the charge facilitator particles m, causing no fog to appear.

The following image evaluations show the effects of the mixing ratio of the charge facilitator particles m relative to toner, that is, the number of parts in weight of the charge facilitator particles m per 100 parts in weight of toner.

(1)

One part of charge facilitator particles m per 100 parts of toner

| | Item 1 | Item 2 |
|---|---|---|
| Embodiment 3 | G | G |
| Embodiment 4 (application of DC bias) | F | G |
| Embodiment 5 (superposition of AC bias) | F | F |

(2)

Four parts charge facilitator particles m per 100 parts of toner

| | Item 1 | Item 2 |
|---|---|---|
| Embodiment 3 | G | G |
| Embodiment 4 (application of DC bias) | F | F |
| Embodiment 5 (superposition of AC bias) | G | NG |

As is evident from the above evaluations, in the case of Embodiment 3, in which the charge facilitator particles m were mixed in the developer t, and image development was carried out with the use of a noncontact-type charging apparatus, a proper amount of the charge facilitator particles m was supplied, preventing electrical charge from being injected into the peripheral surface of the photosensitive member 1, and therefore no fog appeared. As a result, desirable prints were produced.

Figure 5:
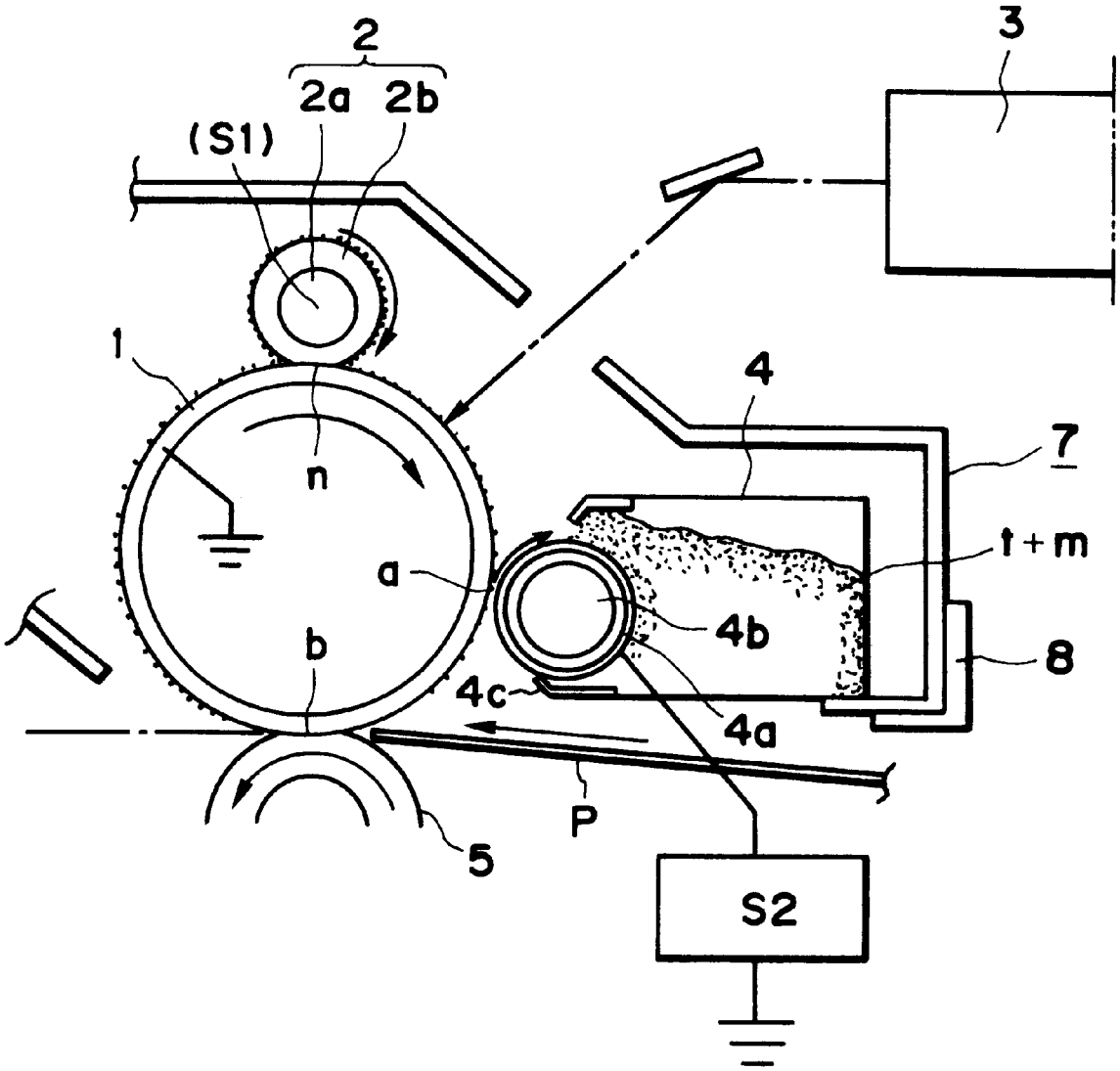
FIG. 5 is a schematic section of the image forming apparatus in the sixth embodiment of the present invention.

Embodiment 6 (FIG. 5)

This embodiment is the same as Embodiment 2, except that the development sleeve 4*a* of the developing apparatus 4 was rotated at a peripheral velocity different from that of the photosensitive member 1.

Specifically, the image forming apparatus was structured as depicted in FIG. 5, and the development sleeve 4*a* was rotatively driven in the clockwise direction so that in the development station a, its rotational direction becomes opposite to the moving direction of the photosensitive member 1, and also, its peripheral velocity becomes 120% different from that of the photosensitive member 1. Otherwise, the printer structure in this embodiment was the same as that in Embodiment 3.

With the provision of the peripheral velocity difference between the development sleeve 4*a,* as a developer carrying member of the developing apparatus 4, which carries the developer to the development station a, and the photosensitive member 1, a sufficient amount of the developer can be supplied to the development station a, and also, a proper amount of the charge facilitator particles m can be supplied. In other words, a sufficient amount of the developer (toner) and the charge facilitator particles m are transferred from the development sleeve 4*a* to the photosensitive member 1, without causing the fog associated with the electrical charge injected into the photosensitive member 1 by the voltage applied to provide the development bias. Therefore, desirable images can be produced.

As is evident from the preceding paragraphs, according to Embodiment 6, contact does not occur between the tip of aggregation of the developer which contains the charge facilitator particles m with low electrical resistance, and the photosensitive member 1 which rotates at a peripheral velocity different from that of the charge roller 2. Therefore, desirable images are produced.

Advantages of Embodiment 6 are summarized below, along with the evaluations of the other embodiments.

Embodiments 7 and 8 are substantially the same as Embodiments 4 and 5, with only a few exceptions. That is, in Embodiments 7 and 8, the development sleeve 4*a* of the development apparatus was rotated also in the clockwise direction, and the moving direction, in the development station a, of the peripheral surface of the development sleeve 4*a* of the developing apparatus was rendered opposite to that of the photosensitive member 1. However, the peripheral velocity difference, in the development station a, between the development sleeve 4*a* and the photosensitive member 1, was set at 120%.

As was in the cases of Embodiments 4 and 5, the weight ratio of the charge facilitator particles m relative to the developer was varied: one, three, and four parts in weight of the charge facilitator particles m to 100 parts in weight of the developer. Then, images were comparatively evaluated.

The criteria for image comparison are the same as those in Embodiment 3.

Item 1: Presence of ghost in solid white areas or intermediately tinted areas, on the downstream side of solid black area.

Item 2: Presence of fog in solid white area.

The evaluation method was also the same as that in Embodiment 3.

(1)

One part of charge facilitator particles m per 100 parts of toner

| | Item 1 | Item 2 |
|---|---|---|
| Embodiment 6 | G | G |
| Embodiment 7 (application of DC bias) | F | G |
| Embodiment 8 (superposition of AC bias) | F | F |

(2)

Three parts of charge facilitator particles m per 100 parts of toner

| | Item 1 | Item 2 |
|---|---|---|
| Embodiment 6 | G | G |
| Embodiment 7 (application of DC bias) | F | F |
| Embodiment 8 (superposition of AC bias) | G | NG |

(3)

Four parts of charge facilitator particles m per 100 parts of toner

| | Item 1 | Item 2 |
|---|---|---|
| Embodiment 6 | G | G |
| Embodiment 7 (application of DC bias) | G | NG |
| Embodiment 8 (superposition of AC bias) | G | NG |

As is evident from the above evaluations, in the case of Embodiment 6, the charge facilitator particles m were mixed in the developer, image development was carried out with the use of a noncontact-type charging apparatus, and also, a peripheral velocity difference was provided between the development sleeve 4*a* and the photosensitive member 1. Therefore, a proper amount of the charge facilitator particles m was supplied, preventing electrical charge from being injected into the peripheral surface of the photosensitive member 1, and therefore no fog appeared. As a result, desirable prints were produced.

Embodiment 9

This embodiment is the same as Embodiment 3, except that the electrical resistance of the photosensitive member 1 as an image bearing member in the printer was adjusted. Otherwise, the printer structure in this embodiment is the same as that in Embodiment 3.

In this embodiment, the electrical resistance at the surface portion of the photosensitive member 1 is adjusted by providing the photosensitive member 1 with a charge injection layer, which constitutes the outermost layer of the photosensitive member 1. Referring again to FIG. 2, which is an enlarged schematic section of a portion of the photosensitive member 1 provided with the charge injection layer employed in this embodiment, and depicts the laminar structure of the photosensitive member 1, the photosensitive member 1 in this embodiment is formed by coating a charge injection layer 16 on the peripheral surface of an ordinary photosensitive member, which is constituted of an aluminum drum 11 (base member), and various layers: an undercoat layer 12, a positive charge injection prevention layer 13, a charge generation layer 14, and a charge transfer layer 15, which are coated on the aluminum drum 11 in this order from the bottom. The charge injection layer 16 is coated to improve the photosensitive member 1 in terms of chargeability.

The electrical resistance value of the charge injection layer 16, which constitutes the outermost layer of the photosensitive member 1, is reduced by dispersing electrically conductive ultramicroscopic particles of $SnO_2$ or the like, as filler, in curable resin as binder, for example, photocurable acrylic resin.

Specifically, $SnO_2$ particles, which are doped with antimony to reduce their electrical resistance, and have an average particle diameter of approximately 0.03 $\mu$m, are dispersed in resin by a weight ratio of 70%, and this resin is coated, as the outermost layer, on the photosensitive member 1 to a thickness of 1 $\mu$m, by dipping. The thus formed charge injection layer becomes approximately $1\times10^{13}$ ohm.cm. Without the dispersion of the electrically conductive particles, the electrical resistance of the charge injection layer was approximately $1\times10^{15}$ ohm.cm. These electrical resistances were measured in an ambience in which temperature and humidity were 25° C. and 40% RH, respectively.

With the reduction in the surface electrical resistance, the photosensitive member 1 in this embodiment was more efficiently, or desirably, charged.

The most important property of the charge injection layer 16 is its electrical resistance. In the case of a method for charging an object by directly injecting charge into the object, the efficiency with which an object is charged is improved by reducing the electrical resistance on the side of the object to be charged. Further, when the object to be charged is a photosensitive member, an electrostatic latent image must be retained for a certain length of time. Therefore, the proper range for the volumetric resistivity of the charge injection layer 16 is $1\times10^{9}$–$1\times10^{14}$ ohm.cm.

It should be noted here that even if a photosensitive member lacks a charge injection layer 16 such as the one described in this embodiment, an effect equivalent to the effect generated by the charge injection layer 16 in this embodiment can be generated if the volumetric resistivity of the charge transfer layer 15, for example, is within the above-described range.

Further, an effect similar to the effect described in this embodiment can be obtained by an amorphous silicon based photosensitive member, the surface layer of which has a volumetric resistivity of approximately $10^{13}$ ohm.cm.

Thus, according to this embodiment, in which the electrical resistance of the surface layer of the photosensitive member 1 is properly controlled, the photosensitive member 1 can be desirably charged through the contact-type charging process, even at a higher process speed; it can be efficiently charged to a desirable potential level, and yet can maintain the electrostatic latent image. Further, the developer and the charge facilitator particles m are supplied only by a proper amount, preventing thereby the appearance of the fog caused by the electrical charge injected into the photosensitive member 1 by the voltage applied to provide the development bias, and therefore, desirable images are produced even in the case of an image forming apparatus in which electrical charge is liable to be injected into the photosensitive member 1 by the developing means.

As described above, the electrical resistance value of the surface layer of a photosensitive member may be controlled so that electrical charge can be more efficiently injected into the photosensitive member, but such control makes it easier for electrical charge to be injected into the photosensitive member by a developing apparatus. Therefore, in this embodiment, a noncontact-type developing apparatus is employed. As a result, desirable charging performance and desirable developing performance are both realized in spite of the employment of a photosensitive member with a controlled, or reduced, surface electrical resistance.

Advantages of Embodiment 9 are summarized in the following, along with the evaluations of the other embodiments.

Embodiments 10 and 11 are substantially the same as Embodiments 4 and 5, with only a few exceptions. That is, in Embodiments 10 and 11, the electrical resistance of the surface layer of the photosensitive member 1 is reduced as described above.

As was in the cases of Embodiments 4 and 5, the weight ratio of the charge facilitator particles m relative to the developer was varied: one, three, and four parts in weight of the charge of the developer. Then, images were comparatively evaluated.

The criteria for image comparison are the same as those in Embodiment 3.

Item 1: presence of ghost in solid white areas or intermediately tinted areas, on the downstream side of solid black area.

Item 2: presence of fog in the solid white area.

The evaluation method was also the same as that in Embodiment 3.

(1)

One part of charge facilitator particles m per 100 parts of toner

| | Item 1 | Item 2 |
|---|---|---|
| Embodiment 9 | G | G |
| Embodiment 10 (application of DC bias) | G | FF |
| Embodiment 11 (superposition of AC bias) | G | F |

(2)

Three parts charge facilitator particles m per 100 parts of toner

| | Item 1 | Item 2 |
|---|---|---|
| Embodiment 9 | G | G |
| Embodiment 10 (application of DC bias) | G | F |
| Embodiment 11 (superposition of AC bias) | G | NG |

(3)

Four parts of charge facilitator particles m per 100 parts of toner

| | Item 1 | Item 2 |
|---|---|---|
| Embodiment 9 | G | G |
| Embodiment 10 (applicatian of DC bias) | G | NG |
| Embodiment 11 (superposition of AC bias) | G | NG |

As is evident from the above evaluations, in terms of Item 1, images are desirable even in the cases of Embodiments 10 and 11 because the photosensitive member 1, the electrical resistance of the surface layer of which has been reduced to improve the efficiency with which electrical charge is injected into the photosensitive member 1, was used. In terms of Item 2, however, fog appears in the cases of the comparative examples, that is, Embodiments 10 and 11. This is due to the fact that the reduction in the electrical resistance of the surface layer of the photosensitive member 1 increases the efficiency with which electrical charge is injected into the photosensitive member 1, and therefore, the photosensitive member 1 is more liable to be injected with electrical charge by a contact-type developing apparatus; image quality is more liable to be reduced by the appearance of the fog associated with the electrical charge injected into the photosensitive member 1 by the developing apparatus.

In comparison, in the case of Embodiment 9, a noncontact-type developing apparatus 4 was employed, and therefore, electrical charge is not injected into the peripheral surface of the photosensitive member 1, causing thereby no fog. Thus, desirable images are produced even though desirable charging performance is realized with the use of a photosensitive member with a reduced surface electrical resistance.

It should be noted here that the developer to be used in a noncontact-type charging apparatus may be either two component developer or nonmagnetic single component.

Next, more embodiments of the image forming apparatus in accordance with the present invention will be described. The following embodiments are different from each other in terms of the charge facilitator particles m coated in advance on a charging member, and the charge facilitator particles m delivered to a charging nip from a developing device by an image bearing member.

Figure 6:
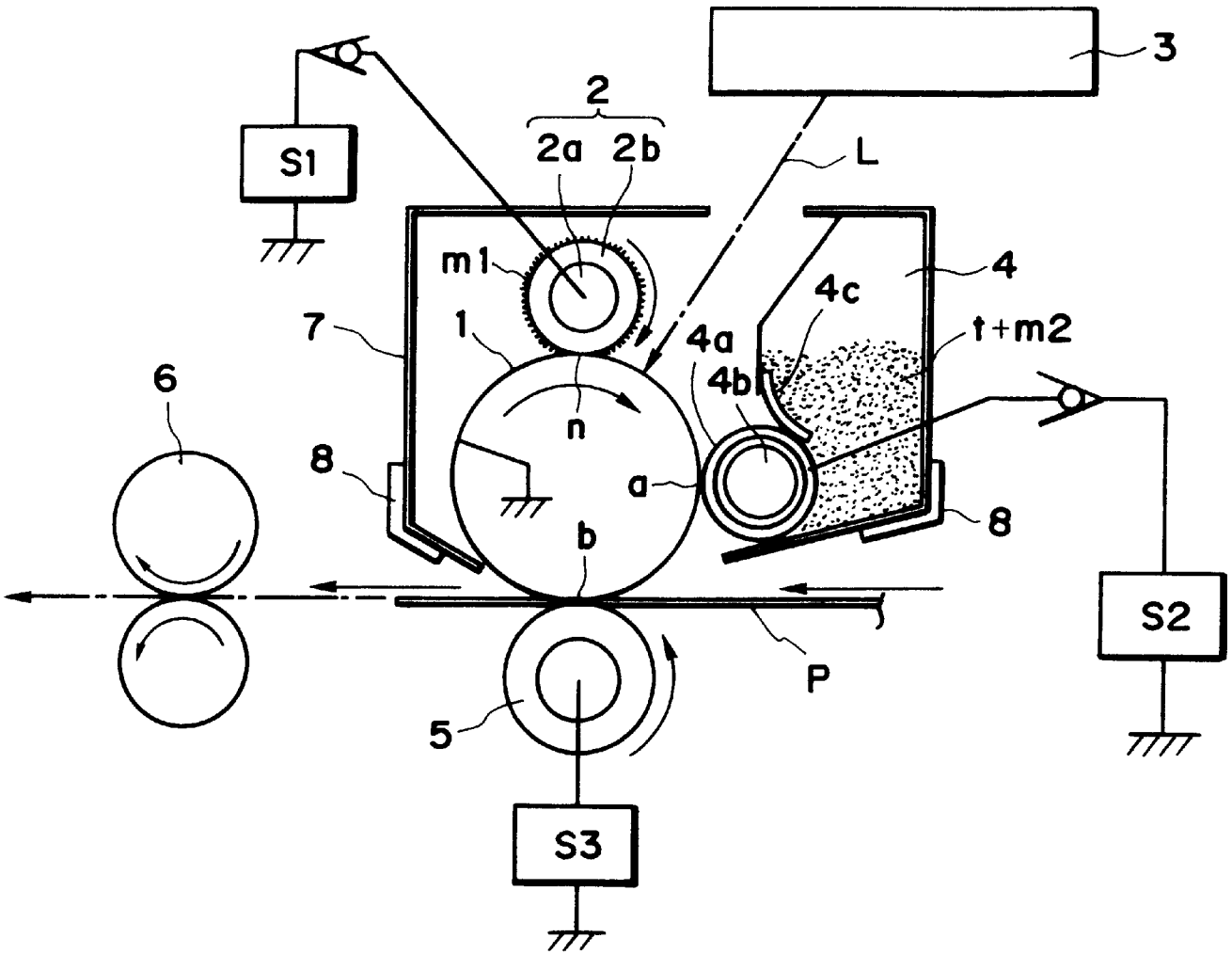
FIG. 6 is an image forming apparatus in the twelfth embodiment of the present invention.

Embodiment 12 (FIG. 6)

FIG. 6 is a schematic section of another example of the image forming apparatus in accordance with the present invention.

The image forming apparatus in this embodiment is a cleanerless laser beam printer (recording apparatus) which employs a transfer-type electrophotographic process, a contact-type charging system, and a cartridge system.

(1) General Structure of Printer

A referential character 1 designates an object to be charged (image bearing member). The object 1 to be charged, in this embodiment, is a cylindrical negatively chargeable photosensitive member (negative photosensitive member, hereinafter, "photosensitive drum") which comprises an organic photoconductor. This photosensitive drum 1 has a diameter of 30 mm and is rotatively driven in the clockwise direction indicated by an arrow mark at a peripheral velocity of 50 mm/sec (process speed PS, printing speed).

Designated by a reference character 2 is an electrically conductive elastic roller (hereinafter, "charge roller") as a contact-type charging member (contact-type charging device), which is placed in contact with the photosensitive member 1, with a predetermined contact pressure. A referential character n designates a charging nip, which is the interface between the photosensitive member 1 and the charge roller 2. The peripheral surface of the charge roller 2 is coated in advance with electrically conductive particles ml (hereinafter "charge facilitator particles for the charging device"). The charge roller 2 and the charge facilitator particles m1 for the charging device will be described later.

The charge roller 2 is rotatively driven so that its rotational direction in the charging nip n, that is, the interface between the charge roller 2 and the photosensitive member 1 becomes opposite (counter) to that of the photosensitive member 1, and so that there exists a peripheral velocity difference between the charge roller 2 and the photosensitive member 1. Further, a predetermined charge bias is applied to the charge roller 2 from a charge bias application power source S1.

With the above arrangement, the peripheral surface of the photosensitive member 1 is uniformly charged to a predetermined polarity and a predetermined potential level through a direct type charging system (charge injection system). This will be described later.

Designated by a reference character 3 is a laser beam scanner (exposing device) which comprises a laser diode, a polygon mirror, and the like. This laser beam scanner 3 outputs a scanning beam of laser light L, the intensity of which is modulated with serial digital electric signals generated by digitizing the optical information of a target image, and which scans, or exposes, the uniformly charged peripheral surface of the photosensitive drum 1. As a result, an electrostatic latent image corresponding to the optical information of the target image is formed on the peripheral surface of the cylindrical photosensitive member 1.

Designated by a reference character 4 is a developing device. In the developer t, electrically conductive particles m2 (hereinafter, "charge facilitator particles for the developing device") have been mixed. The electrostatic latent image on the peripheral surface of the cylindrical photosensitive drum 1 is developed into a toner image by this developing device 4, in the development station a. This developing device 4 and the charge facilitator particles m2 for the developing device will be described later.

Designated by a reference character 5 is a transfer roller with intermediary electrical resistance. It forms a transfer nip b at a point at which it is pressed against the peripheral surface of the photosensitive drum 1, with a predetermined pressure. Into this transfer nip b, a sheet of recording medium, or a transfer sheet P, which is delivered from an unillustrated sheet feeder portion, is fed while a transfer bias with a predetermined voltage level is being applied to the transfer roller 5 from a transfer bias application power source S3. As a result, the toner image on the photosensitive drum 1 sides is transferred, sequentially from one end to the other, onto the surface of the transfer sheet P fed into the transfer nip b. In this embodiment, the electrical resistance of the transfer roller 5 is $5\times10^8$ Ω, and the toner image is transferred by applying a DC voltage of +2000 V to the transfer roller 5. During image transfer, the transfer sheet P is guided into the transfer nip b, and the toner image which has been formed and held on the peripheral surface of the photosensitive drum 1 is transferred, sequentially from one end of the image to the other, onto the top side of the transfer sheet P by the electrostatic force and the nip pressure, while the transfer sheet P is conveyed through the transfer nip b, being pinched by the transfer roller 5 and the photosensitive drum 1.

Designated by a reference character 6 is a fixing apparatus. After being fed into the transfer nip b and receiving the toner image transferred from the photosensitive drum 1 side, the transfer sheet P is separated from the peripheral surface of the cylindrical photosensitive drum 1, and then is guided into the fixing apparatus 6, in which the toner image is permanently fixed to the transfer sheet P. Thereafter, the transfer sheet P is discharged from the apparatus as a print or a copy.

The printer in this embodiment is of a cleanerless type. Thus, the residual toner, or the toner which remains on the peripheral surface of the cylindrical photosensitive drum 1 after a toner image is transferred onto a transfer sheet P, is not removed by a dedicated cleaner (cleaning apparatus), but instead, is carried to the location of the charge roller 2, or the charging nip n. As the photosensitive drum 1 is further rotated, the residual toner is carried to the development station a, in which the residual toner is removed (recovered) by the developing apparatus at the same time as the electrostatic latent image is developed (toner recycling process).

A reference numeral 7 designates a process cartridge which is replaceably installable in the main assembly of a printer. The process cartridge in this embodiment comprises three processing devices: a photosensitive drum 1, a charge roller 2 and a development apparatus 4. The three devices are integrally disposed in a cartridge removably installable in the main assembly of a printer. The combination of the processing devices disposed in the process cartridge is not limited to the above described one; it is optional. Reference numerals and 8 and 8 designate guides, which guide a process cartridge when the process cartridge is installed or removed, and which hold the process cartridge after the installation.

(2) Charge Roller 2

The charge roller 2 as a contact-type charging member in this embodiment is constituted of a metallic core 2*a,* and a layer 2*b* of elastic material such as rubber or foamed material laid on the peripheral surface of the metallic core 2*a*. The elastic layer 2*b* has an intermediary resistance.

The intermediary resistance layer 2*b* is composed of resin (for example, urethane), electrically conductive particles (for example, carbon black), sulfurizing agent, foaming agent, etc., and is laid on the peripheral surface of the metallic core 2*a* to form a roller along with the metallic core 2. After being laid on the metallic core 2*a,* the surface of the medium resistance layer 2*b* is polished, if necessary, to obtain the charge roller 2, that is, an electrically conductive elastic roller measuring 12 mm in diameter and 200 mm in length.

The measured electrical resistance of the charge roller 2 in this embodiment was 100 kΩ. More specifically, the resistance of the charge roller 2 was measured in the following manner. The charge roller 2 was placed in contact with an aluminum drum with a diameter of 30 mm, so that the metallic core 2*a* of the charge roller 2 was subjected to an overall load of 1 kg, and then, the resistance of the charge roller 2 was measured while applying 100 V between the metallic core 2*a* and the aluminum drum.

In this embodiment, it is important that the charge roller 2, which is a contact-type charging member, functions as an electrode. In other words, the charge roller 2, which is a contact-type charging member, must be rendered elastic so that it is able to create a desirable state of contact between the charge roller 2 and the object to be charged, and also its electrical resistance is desired to be sufficiently low to charge a moving object. On the other hand, it is desired to be able to prevent voltage from leaking through the defective portions in terms of electrical resistance, for example, pin holes, of an object to be charged, just in case such defects exist. Therefore, when the object to be charged is an electrophotographic photosensitive member, the electrical resistance of the charge roller 2 is desired to be in a range of $10^4$–$10^7$ Ω so that satisfactory charging performance and leak resistance is realized.

On the peripheral surface of this charge roller 2, the electrically conductive charge facilitator particles ml for a charging device are uniformly coated in advance.

In order for the charge roller 2 to be able to hold the charge facilitator particles ml, the peripheral surface of the charge roller 2 is desired to be provided with microscopic irregularities as the surface of a sponge is irregular.

As for the hardness of the charge roller 2, if it is too low, the shape of the charge roller 2 becomes too unstable to maintain the desirable state of contact between the charge roller 2 and the object to be charged. If it is too high, the charge roller 2 fails to form a desirable charging nip between itself and the object to be charged, and also the state of contact between the charge roller 2 and the object to be charged, within the charging nip becomes inferior in terms of microscopic level. Therefore, the desirable hardness range for the charge roller 2 is 25–50 deg. in the Asker-C scale.

The material for the charge roller 2 is not limited to the elastic formed material described above. In addition to the material described above, it is possible to use EPDM, urethane, NBR, silicone rubber, IR, and the like, in which electrically conductive particles such as carbon black or metallic oxide particles have been dispersed, and the foamed version of the same materials. It should be noted here that the resistances of the materials may be adjusted with the use of ion conductive material, instead of dispersing the electrically conductive particles.

The charge roller 2 is placed in contact with the photosensitive drum 1 is an object to be charged, being pressed against its own elasticity, with a predetermined contact pressure.

In this embodiment, the charge roller 2 is rotatively driven in the clockwise direction indicated by an arrow mark at approximately 80 rpm, so that the peripheral surfaces of the charge roller 2 and the photosensitive member 1 move at the same velocity in the opposite directions in the charging nip n. In other words, the charge roller 2 and the photosensitive member 1 are driven so that there exists a peripheral velocity different between the surface of the charge roller 2 as the contact-type charging member, and the surface of the photosensitive member 1 as the object to be charged.

To the metallic core 2*a* of the charge roller 2, a DC voltage of −700 V is applied as the charge bias from a charge bias application power source S1.

In this embodiment, the peripheral surface of the photosensitive member 1 is uniformly charged through a direct charging system, to a potential level of −680 V which is substantially equal to the level of the voltage applied to the charge roller 2.

(3) Developing Device 4

The developing device 4 is reversal-type developing device, which employs a simple component magnetic toner (negative toner) as developer t.

A reference alphanumeric character 4*a* designates a non-magnetic development sleeve as a developer carrier member, which encases a magnetic roller 4*b,* and is rotatively driven. The developer t is coated, in a thin layer, on this rotatable development sleeve 4*a* by a regulator blade 4*c.*

The developer t is regulated in terms of the thickness of its layer by the regulator blade 4*c,* and also electrically charged by the regulator blade 4*c* as it is coated on the development sleeve 4*a.*

The developer coated on the rotatable development sleeve 4*a* is carried to the developing station a, that is, the interface between the photosensitive member 1 and the sleeve 4*a* as the sleeve is rotated. To the sleeve 4*a,* development bias voltage is applied from a development bias application power source S2. The development bias voltage used in this embodiment is a compound voltage composed of a DC voltage of −500 V, and an AC voltage with a frequency of 1800 Hz, a peak-to-peak voltage of 1600 V, and a rectangular waveform. With this arrangement, an electrostatic latent image on the photosensitive member 1 side is developed into a toner image.

The developer t, which is single component toner, is composed of binder resin, magnetic particles, and charge controller particles, manufactured through each of the following production steps: mixing-kneading; pulverizing; and classifying. After the classifying step, fluidizing agent is added to complete the developer t. The weight average particle diameter (D4) was approximately 7 $\mu$m.

In this embodiment, the electrical conductive charge facilitator particles m2 for a developing device are added to the developer t.

(4) Charge Facilitator Particles ml for Charging Device, and m2 for Developing Device a) Charge Facilitator Particles ml for Charging Device In this embodiment, electrically conductive zinc oxide particles, which have a specific resistivity of $10^6$ Ω.cm and an average particle diameter of 30 mm, are used as the charge facilitator particles ml for the charging device. These particles are uniformly coated in advance on the peripheral surface of the charge roller 2 as a contact-type charging member.

The amount of the charge facilitator particles ml for the developing device, which are to be coated in advance on the peripheral surface of the charge roller 2, is desired to be approximately 1000 to 5×100000 particle/mm$^2$. If it is less than 1000 particle/mm$^2$, the efficiency with which the photosensitive member 1 is charged is low at the beginning of a printing operation. If it is more than 5×100000 particle/mm$^2$, the amount of the charge facilitator particles ml which separate from the charge roller 2 and transfer onto the photosensitive member 1 is large, causing the photosensitive member 1 to be insufficiently exposed regardless of the light transmittance of the charge facilitator particles ml.

The method for measuring the amount of the particles on the peripheral surface of the charge roller 2 is as follows. Specifically, the peripheral surface of the charge roller 2 is photographed by a video-microscope (product of Olympus: OVM1000N) and a digital still recorder (product of Deltis: SR-3100). In photographing the peripheral surface of the charge roller 2, the charge roller 2 is pressed against a piece of side glass under the same condition as the charge roller 2 is pressed against the photosensitive drum 1, and no less than 10 spots in the interface between the charge roller 2 and the slide glass were photographed with the use of the video-microscope fitted with an object lens with a magnification power of 1000 from behind the slide glass. The thus obtained digital images are digitally processed using a predetermined threshold. Then, the number of cells in which charge facilitator particles are present in calculated with the use of a designated image processing software.

The particle diameter of the charge facilitator particles ml for the charging device was rendered smaller than that of the charge facilitator particles m2 for the developing device, to make them less liable to separate from the peripheral surface of the charge roller 2.

In consideration of the adhesion to the peripheral surface of the charge roller 2, and also to uniformly charge the photosensitive member 1, the particle diameter of the charge facilitator particles ml for the charging device is desirable to be smaller, that is, smaller than that of the charge facilitator particles m2 for the developing device. More specifically, it is desired to be no more than 500 nm. However, in consideration of the stability of the particles, 10 nm is the bottom limit.

As for the material for the charge facilitator particles, many other electrically conductive particles are usable; for example, metallic oxides other than the zinc oxide mentioned above, a mixture of electrically conductive particles and organic materials, and also particles produced by treating the surfaces of these particles.

The specific resistance of the charge facilitator particles is desired to be no more than $10^{12}$ Ω.cm, preferably, no more than $10^{10}$ Ω.cm, since electrical charge is given or received through the charge facilitator particles.

In order to uniformly charge an object, the average diameter of the charge facilitator particles m1 is desired to be no more than 50 $\mu$m.

When the charge facilitator particle m1 is in the form of a granule, the diameter of the granule is defined as the average diameter of charge facilitator granules.

The diameter of the charge facilitator granule is determined based on the following method. First, 100 or more granules are picked with the use of an optical or electron microscope, and their maximum chord lengths in the horizontal direction are measured. Then, their volumetric particle distribution is calculated from the result of the measurement. Based on this distribution, a 50% average granule diameter is calculated to be used as the average granule diameter of the charge facilitator granules.

As described above, the charge facilitator particles are in the primary state, that is, a powdery state, as well as in the secondary state, that is, a granular state. Neither state creates a problem. Whether the charge facilitator is in the powdery state or in the granular state, the state of the charge facilitator does not matter as long as it can function as the charge facilitator.

The charge facilitator particles m are desired to be colorless and transparent particles, or virtually colorless and transparent particles so that they do not become an obstruction when they are used to facilitate the process in which a photosensitive member 1 is exposed to form a latent image. This is rather important in consideration of the fact that the charge facilitator particles might transfer from the photosensitive member 1 onto a recording sheet P when an image is recorded in color.

b) Charge Facilitator Particles m2 for Developing Device

In this embodiment, electrically conductive zinc oxide particles, which have a specific resistivity of $10^6$ Ω.cm and an average particle diameter of 3 μm, are used as the charge facilitator particles m2 for the developing device, which are added to toner t. The ratio of the charge facilitator particles m2 for the developing apparatus relative to the toner t is two parts in weight of the charge facilitator particles m2 per 100 parts in weight of the toner t.

Except for the particle diameter, the charge facilitator particles m2 for the developing device are the same as the charge facilitator particles ml for the charging device, described above.

If the particle diameter of the charge facilitator particles m2 for the developing device is extremely small, the charge facilitator particles m2, which have a low electrical resistance, cover the surfaces of the toner particles, preventing the toner particles from being sufficiently charged by friction, and therefore, reducing the efficiency with which the photosensitive member 1 is charged. On the contrary, if the particle diameter of the charge facilitator particles m2 is extremely large, the charge facilitator particles m2 may block light during an exposing operation, or their presence may be too conspicuous among the toner particles, creating an unnatural impression, which reduces image quality. Thus, the particle diameter of the electrically conductive particles to be added to the developer is desired to be no less than 0.1 μm, and no more than the particle diameter of toner.

C) Functions of Particles m1 and m2

(1) The aforementioned charge facilitator particles m1 for the charging device, and charge facilitator particles m2 for the developing device, are particles, the objective of which is to facilitate a charging process. These particles m1 and m2 are placed in a charging nip n, that is, the interface between the photosensitive member 1 as an object to be charged, and the charge roller 2 as a contact-type charging member, to utilize the lubricative effect of the particles m1 and m2 to reduce the friction between the peripheral surfaces of the charge roller 2 and the photosensitive member 1. This is because it is practically impossible to rotate the charge roller 2 in contact with the photosensitive member 1 while maintaining a peripheral velocity difference from the photosensitive member 1, unless the friction between the charge roller 2 and the photosensitive member 1 is reduced. Further, not only does the presence of the particles m1 and/or m2 in the charging nip n allow the charge roller 2 to be easily and efficiently rotated in contact with the photosensitive member 1 while maintaining a peripheral velocity difference relative to the photosensitive member 1, but it also improves the state of contact between the peripheral surfaces of the charge roller 2 and photosensitive member 1, that is, eliminates the microscopic gaps between the two surfaces as much as possible, increasing thereby the duration of the contact between the two surfaces.

The provision of the peripheral velocity difference between the charge roller 2 and photosensitive member 1 drastically increases the frequency at which the electrically conductive particles m1 and/or m2 make contact with the photosensitive member 1, or increases the duration of their contact with the photosensitive member 1; in other words, the electrically conductive particles m1 and/or m2 present at the interface between the charge roller 2 and the photosensitive member 1 rub the surface of the photosensitive member 1, leaving substantially no gap between the surfaces of the charge roller 2 and photosensitive member 1, creating such a state of contact between the two surfaces that allows electrical charge to be truly directly injected into the photosensitive member 1. In other words, the presence of the electrically conductive particles m1 and/or m2 between the charge roller 2 and the photosensitive member 1 makes the direct charging mechanism (charge injection) the dominant mechanism in the contact-type charging of the photosensitive member 1 by the charge roller 2.

Therefore, it is possible to realize higher charge efficiency which a charge roller based charging method prior to the present invention could not attain; the photosensitive member 1 can be charged to a potential level substantially equal to the level of the voltage applied to the charge roller 2.

Thus, even when the charge roller 2 is employed as a contact-type charging member, the level of the bias voltage to be applied to the charge roller 2 to charge the photosensitive member 1 has only to be substantially equal to the potential level to which the photosensitive member 1 is to be charged, making it possible to realize a contact-type charging system or apparatus which does not rely on electrical discharge, that is, a safe and reliable contact-type charging system or apparatus.

(2) The electrically conductive charge facilitator particles m1 for the charging device are coated in advance on the peripheral surface of the charge roller 2 to make it possible for the photosensitive member 1 to be directly and efficiently charged by the charge roller 2 from the very beginning of a printing operation, through the aforementioned direct charging process.

(3) The electrically conductive charge facilitator particles m2 for the developing device are mixed into the developer t so that a proper amount transfer, along with toner particles, to the photosensitive member 1 in the development station a, as an electrostatic latent image on the photosensitive member 1 is developed into a toner image by the developing device 4.

In the transfer nip b, the toner image on the photosensitive drum 1 is affected, that is, attracted toward the transfer sheet P, by the transfer bias, and aggressively transfers onto a transfer sheet P, but the charge facilitator particles for the developing device, on the photosensitive drum 1 do not aggressively transfer onto the transfer sheet P, and remain on the peripheral surface of the photosensitive drum 1, being practically adhered thereto, since they are electrically conductive.

In addition, the printer is of a cleanerless type, and therefore, the charge facilitator particles m2 for the developing device, which remain on the peripheral surface of the photosensitive member 1 after image transfer, are not removed from the photosensitive member 1, and are carried by the movement of the peripheral surface of the photosensitive member 1, straight to the charging nip n, or the interface between the photosensitive member 1 and the charge roller 2, in which they adhere to the charge roller 2; the charge roller 2 is supplied with the charge facilitator particles m2 for the developing device.

Obviously, a certain amount of the electrically conductive particles fall off the charge roller 2. However, as a printer is operated, the electrically conductive charge facilitator particles m2 for the developing device, which are mixed in the developer t in the developing device 4, continuously transfer onto the photosensitive member 1 in the development station a, are carried through the transfer nip b, and then are delivered to the charging nip n, by the movement of the peripheral surface of the photosensitive member 1. In other words, the charge facilitator particles m2 for the developing device are continuously supplied to the charge roller 2 in the charging nip n, assuring the presence of the electrically conductive particles m1 and/or m2 in the charging nip n, which in turn assures that the photosensitive member 1 is desirably charged for the duration of a printing operation from the very beginning of the printing operation, even though a certain percent of the electrically conductive particles fall off the charge roller 2.

The electrically conductive particles which fall off the charge roller 2 are recovered by the developing device 4, in which they are mixed into the developer t to be recycled.

(4) Since the printer is of a cleanerless type, the toner which remains on the peripheral surface of the photosensitive member 1 after image transfer are carried, without being removed by a cleaner, to the charging nip n, that is, the interface between the photosensitive member 1 and the charge roller 2, in which they adhere to the charge roller 2. However, in this embodiment, the electrically conductive particles m1 and/or m2 are always present in the charging nip n, or the interface between the photosensitive member 1 and charge roller 2. Therefore, the contact between the photosensitive member 1 and charge roller 2 is maintained in a desirable state in terms of microscopic gaps, and friction, in spite of the contamination of the charge roller 2 with the residual toner, that is, the aforementioned adhesion of the toner to the charge roller 2. Thus, the direct-type charging system in accordance with the present invention takes relatively low voltage to charge the photosensitive member 1, and therefore, generates no ozone, and yet is capable of uniformly charging the photosensitive member 1 for a long period of time.

Further, the charge roller 2 is placed in contact with the photosensitive member 1, and yet is allowed to maintain a peripheral velocity difference relative to the photosensitive member 1. Therefore, the residual toner, which is moved, maintaining the ghostly pattern of the just transferred image, from the transfer nip a to the charging nip n, is disturbed, being thereby caused to lose the ghostly pattern, by the charge roller 2 in the nip n. Thus, the pattern of the preceding image does not appear as ghost in the intermediately tinted areas of a finished print.

The residual toner which adheres to the charge roller 2 is gradually expelled from the charge roller 2 onto the photosensitive member 1, is carried to the development station by the movement of the peripheral surface of the photosensitive member 1, and then is cleaned (recovered) by the developing means at the same time as the latent image on the photosensitive member 1 is developed.

Embodiment 13 (FIG. 2)

This embodiment is substantially the same Embodiment 12, except that the electrical resistance of the surface layer of the photosensitive member 1 as an object to be charged is adjusted so that the photosensitive member 1 can be more uniformly and reliably charged.

More specifically, the electrical resistance of the surface layer of the photosensitive member 1 is reduced within a range in which an electrostatic latent image formed on the photosensitive member 1 does not dissipate. With this arrangement, along with the presence of the charge facilitator particles m1 and/or m2 at the interface between the photosensitive member 1 and the charge roller 2, even if the true size of the interface is reduced by the adhesion of the residual toner to the charge roller 2, electrical charge can be effectively given from the charge roller 2 to the photosensitive member 1.

FIG. 2 is an enlarged schematic section of a portion of the photosensitive member 1 provided with the charge injection layer employed in this embodiment, and depicts the laminar structure of the photosensitive member 1. In this embodiment, the photosensitive member 1 is formed by coating a charge injection layer 16 on the peripheral surface of an ordinary photosensitive member, which is constituted of an aluminum drum 11 (base member), and various layers including an undercoat layer 12, a positive charge injection prevention layer 13, a charge generation layer 14, and a charge transfer layer 15, which are coated on the aluminum drum 11 in this order from the bottom. The charge injection layer 16 is coated to improve the photosensitive member 1 in terms of chargeability.

The charge injection layer 16 is composed of binder, electrically conductive particles 16*a* (electrically conductive filler), lubricant, polymerization initiator, and the like. The binder is photocurable acrylic resin, and the electrically conductive particles 16*a* are ultramicroscopic particles of $SnO_2$ (approximately 0.03 $\mu$m in diameter). The lubricant is tetrafluoroethylene (Teflon). The filler, the lubricant, the polymerization initiator, and the like are mixedly dispersed to the binder. Then, the mixture is coated on an ordinary photosensitive member, and is photocured.

The most important property of the charge injection layer 16 is its electrical resistance. In the case of a method for charging an object by directly injecting charge into the object, the efficiency with which an object is charged is improved by reducing the electrical resistance on the side of the object to be charged. Further, when the object to be charged is a photosensitive member, an electrostatic latent image must be retained for a certain length of time. Therefore, the proper range for the volumetric resistivity of the charge injection layer 16 is $1\times10^{9}$–$1\times10^{14}$ Ω.cm.

It should be noted here that even if a photosensitive member lacks a charge injection layer 16 such as the one described in this embodiment, an effect equivalent to the effect generated by the charge injection layer 16 in this embodiment can be generated if the volumetric resistivity of the charge transfer layer 15, for example, is within the above-described range.

Further, an effect similar to the effect described in this embodiment can be obtained by an amorphous silicon based photosensitive member, the surface layer of which has a volumetric resistivity of approximately $10^{13}$ Ω.cm.

Evaluation of Embodiments 12 and 13

Advantages of Embodiments 12 and 13 are given below along with those of Embodiments 14 and 15.

TABLE 2

| Embodiment | Diameter of m1 | Diameter of m2 | Performance (number of print/print speed m/sec) 0/50 | 100/50 | 1000/50 | 10000/50 | 10000/100 |
|---|---|---|---|---|---|---|---|
| 14 | N/A | 3 μm | NG | G | G | F | NG |
| 15 | 3 μm | 3 μm | G | G | G | F | NG |
| 12 | 30 nm | 3 μm | G | G | G | G | F |
| 13 | 30 nm | 3 μm | G | G | G | G | G |

Embodiment 14

This embodiment is substantially the same as Embodiment 12, except that the charge facilitator particles m1 for the charging device were not coated in advance on the charge roller 2, although a predetermined amount of the charge facilitator particles m2 for the developing device is mixed in the developer t.

Embodiment 15

This embodiment is substantially the same as Embodiment 12, except that the particle diameter of the charge facilitator particles m1 for the charging device, which are coated on the charge roller 2, was made to be 3 μm which was the same as that of the charge facilitator particles m2 for the developing device.

Evaluation of Charging Performance

In each of Embodiments 12–15, the image forming apparatuses (printers) different in printing speed (50 mm/sec and 100 mm/sec) were employed, and the image quality was evaluated in terms of irregularity. The revolution of the charge roller 2 was set so that the peripheral velocity ratio between the charge roller 2 and the photosensitive member 1 remained the same across the image forming apparatuses regardless of the printing speed.

NG: Traces of insufficient charge even in solid white areas.

F: No trace of insufficient charge in solid white areas, but traces of insufficient charge in intermediately tinted areas.

G: No trace of insufficient charge in solid white area and intermediary tinted areas.

As is evident from Table 2, in the case of Embodiment 14, in which the charge facilitator particles m1 for the charging device were not coated in advance on the charge roller 2, charging performance was not desirable at the beginning of a printing operation, but gradually improved after approximately 100 prints were produced. This is because the charge facilitator particles m2 added to the developer t in the developing device 4 were gradually delivered to the charging nip n. However, after 10000 or so prints are made, the amount of substance with high electrical resistance, such as toner or paper dust, which has adhered to the peripheral surface of the charge roller 2 becomes rather large, reducing the charging performance. As a result, the traces of insufficient charge, that is, the irregularity, appeared in the intermediately tinted areas of the finished images.

In the case of Embodiment 15, the charging performance is at a desirable level at the beginning of a printing operation, since the charge facilitator particles m1 for the charging device were coated in advance on the charge roller 2. However, after approximately 10000 prints were made, irregularity associated with insufficient charge appeared in the intermediately tinted areas of the finished images.

In Embodiment 12, the particle diameter of the charge facilitator particles m1 for the charging device, which were to be coated in advance on the charge roller 2, was rendered smaller than that of the charge facilitator particles m2 for the developing device, reducing thereby the adhesive force between the developer t and the peripheral surface of the charge roller 2. As a result, the developer t did not adhere to the peripheral surface of the charge roller 2 as much as it did in the case of Embodiment 15. Thus, not only was the charging performance desirable at the beginning of a printing operation, but also the desirable charging performance was maintained even after printing 10000 copies.

In Embodiment 13, the outermost layer of the photosensitive drum was constituted of the charge injection layer 16. Therefore, the charging performance was desirable from the beginning of a printing operation, and this desirable charging performance was maintained even after printing 10000 copies. This was true even when the printing speed was set at a higher speed of 100 mm/sec.

As mentioned before, when an image forming apparatus employing a roller-type charging system prior to the present invention was used in a high temperature—high humidity environment, the apparatus was liable to produce images with an appearance of flowing water associated with blurring of a latent image. This phenomenon occurred because the electrical resistance of the peripheral surface of the prior photosensitive member was reduced due to the absorption or the like of ozonic produces, which in turn blurred the latent image. However, with the employment of the charging system in accordance with the present invention, none of the prints suffered from the appearance of flowing water regardless of the image forming apparatus structure.

Miscellaneous

1) In order for the residual toner, that is, the toner which remains on an image bearing member after image transfer, and is carried into a charging station, to be temporarily transferred to a contact-type charging member, a contact-type charging member is desired to be structured so that it is rotatively driven, and its rotational direction is opposite to the moving direction of the peripheral surface of an image bearing member. With this arrangement, the residual toner on the image bearing member is temporarily separated from the image bearing member, and then, the image bearing member is directly charged. Therefore, the image bearing is more directly, hence, more efficiently, charged.

It is feasible to create the peripheral velocity difference by moving the peripheral surfaces of both the charging member and the image bearing member, in the same direction in the charging nip. However, the effectiveness of the charge injection is dependent upon the ratio between the peripheral velocities of the charging member and the image bearing member, and in order to create, while moving the two surfaces in the same direction, a peripheral velocity difference equal to the peripheral velocity difference created by moving the two surfaces in the directions opposite to each other, the number of revolutions of the charging roller must be rather drastically increased compared to when the two surfaces are moved in the different direction. Therefore, moving the two surfaces in the opposite directions to each other is advantageous in terms of the number of revolutions of the charging roller. The peripheral velocity difference, here, is defined as follows:

Peripheral velocity difference (%)={(peripheral velocity of charging member−peripheral velocity of image bearing member)/peripheral velocity of image bearing member}×100

In the above formula, the values of the peripheral velocities of the charging member and the image bearing member are the absolute values of the velocities.

2) The choice of the contact-type charging member does not need to be limited to the charge rollers described in the preceding embodiments.

In addition to the above-described charge rollers, contact-type charging members which are different, in material and/or form, from the above charge rollers, for example, a fiber brush, or a piece of felt or the like cloth, may be employed. Further, these materials and forms may be used in various combinations to realize better elasticity and electrical conductivity.

3) The charge bias applied to a contact-type charging member 2 or the development bias applied to a development sleeve 4*a* may be compound voltage composed of DC voltage and an alternating voltage (AC voltage).

The waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

4) The choice of the means for exposing the surface of an image bearing member to form an electrostatic latent image does not need to be limited to the laser based digital exposing means described in the preceding embodiments. It may be an ordinary analog exposing means, a light emitting element such as an LED, or a combination of a light emitting element such as a fluorescent light and a liquid crystal shutter. In other words, it does not matter as long as it can form an electrostatic latent image corresponding to the optical information of a target image.

An image bearing member may be constituted of a dielectric member with an electrostatic recording faculty. In the case of such a dielectric member, the surface of the dielectric member is uniformly charged to a predetermined polarity and a predetermined potential level and then, the charge given to the surface of the dielectric member is selectively removed with the use of a charge removing means such as a charge removing needle head or an electron gun to white from the electrostatic latent image of a target image on the surface.

5) The choice of the developing means 4 does not need to be limited to developing apparatuses which employ a single component magnetic toner, although the developing apparatus was described as such in this specification.

6) The recording medium onto which a toner image is transferred from an image bearing member may be constituted of an intermediary transfer member such as a transfer drum.

7) One of the methods for measuring the size of toner particles is as follows. A measuring apparatus is a Coulter counter TA-2 (product of Coulter Co., Ltd.). To this apparatus, an interface (product of Nippon Kagaku Seiki) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 $\mu$m in particle size is measured with the use of the aforementioned Coulter coulter TA-2, the aperture of which is set at 100 $\mu$m, and the volumetric average distribution of the toner particles is obtained. Finally, the volumetric average particle size of the toner particles is calculated from the thus obtained volumetric average distribution of the toner particles.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a movable image bearing member;

means for forming an electrostatic latent image on said image bearing member, said image forming means including a charging member to which voltage is applicable to charge said image bearing member, said charging member comprising a flexible member for forming a nip between itself and said image bearing member; and means for developing the latent image with toner particles to which non-magnetic electrically conductive particles are externally added, and for supplying the non-magnetic electrically conductive particles to said image bearing member, said developing means removing residual toner particles from said image bearing member;

wherein the electrically conductive particles transferred onto said image bearing member by said developing means are carried to the nip on said image bearing member;

wherein said flexible member is moved to provide a peripheral speed difference between itself and said image bearing member.

2. An image forming apparatus according to claim 1, wherein a volumetric resistivity of the electrically conductive particles is no more than $10^{12}$ Ω.cm.

3. An image forming apparatus according to claim 1, wherein a volumetric resistivity of the electrically conductive particles is no more than $10^{10}$ Ω.cm.

4. An image forming apparatus according to claim 1, wherein an average particle diameter of the electrically conductive particles is no more than 50 $\mu$m.

5. An image forming apparatus according to claim 1, wherein an average particle diameter of the electrically conductive particles is no more than half an average particle diameter of the toner particles.

6. An image forming apparatus according to claim 1, wherein a volumetric resistivity of the electrically conductive particles contained in the developer is no more than $1\times10^{19}$ Ω.cm.

7. An image forming apparatus according to claim 1, wherein a moving direction of a peripheral surface of said image bearing member, in the nip, is opposite to a moving direction of the peripheral surface of said flexible member, in the nip.

8. An image forming apparatus according to claim 1, wherein said flexible member is made of an elastic member.

9. An image forming apparatus according to claim 1, wherein said flexible member is made of a foamed elastic member.

10. An image forming apparatus according to claim 1, wherein said developing means reversely develops latent images with the use of toner.

11. An image forming apparatus according to claim 1, wherein said developing means carries out a cleaning process while carrying out a developing process.

12. An image forming apparatus according to claim 1, wherein said developing means comprises a member which carries the developer in such a manner that the developer is not allowed to come in contact with said image bearing member, in an image developing area.

13. An image forming apparatus according to claim 1, wherein said charging member is in the form of a roller.

14. An image forming apparatus according to claim 1, wherein said flexible member is in the form of a fiber brush.

15. An image forming apparatus according to any of claims 1–14, wherein said charging member injects electrical charge into said image bearing member, in the nip.

16. An image forming apparatus according to claim 1, wherein said image bearing member has a surface layer with a volumetric resistivity of no more than $1\times10^{14}$ Ω.cm.

17. An image forming apparatus according to claim 16, wherein a volumetric resistivity of the surface layer is no less than $1\times10^{9}$ Ω.cm.

18. An image forming apparatus according to claim 17, wherein said image bearing member comprises an electrophotographic photosensitive layer inside the surface layer.

19. An image forming apparatus comprising:

a movable photosensitive member;

a charging member, contacting said photosensitive member, for charging said photosensitive member;

exposure means for forming an electrostatic latent image by exposing said photosensitive member charged by said charging member to image light;

developing means for developing the electrostatic latent image with toner and for supplying non-magnetic electroconductive particles on a surface of said photosensitive member; and transfer means for transferring the developed image onto a transfer material with the non-magnetic electroconductive particles being substantially retained on the surface of said photosensitive member, wherein said charging member applies electric charge, through the non-magnetic electroconductive particles, to the surface of said photosensitive member having the non-magnetic electroconductive particles thereon.

20. An apparatus according to claim 19, wherein said charging member has a surface elastic layer.

21. An apparatus according to claim 20, wherein said surface elastic layer is a foam layer.

22. An apparatus according to claim 19, wherein a volumetric resistivity of the electroconductive particles is no more than $10^{12}$ Ωcm.

23. An apparatus according to claim 22, wherein a volumetric resistivity of the electroconductive particles is no more than $10^{10}$ Ωcm.

24. An apparatus according to claim 19, an average particle diameter of the electroconductive particles is no more than 50 μm.

25. An apparatus according to claim 19, wherein the electroconductive particles have particles sizes which are less than one half of a weight average particle size of the toner.

26. An apparatus according to claim 19, wherein said charging member is coated beforehand with electroconductive particles having a particle size smaller than that of the electroconductive particles supplied by said developing means.

27. An apparatus according to claim 19, wherein a smaller particle size is not less than 10 nm and not more than 500 nm, and a particle size of the electroconductive particles supplied by said developing means is not less than 0.1 micron and not more than the weight average particle size of the toner.

28. An apparatus according to claim 19, wherein said charging member rubs said photosensitive member.

29. An apparatus according to claim 28, wherein said charging member and said photosensitive member move in the opposite direction from each other at a contact position therebetween.

30. An apparatus according to claim 19, wherein said developing means is of a one component developing type.

31. An apparatus according to claim 30, wherein said developing means is of a one component magnetic developing type.

32. An apparatus according to claim 19, wherein said charging member is in the form of a roller.

33. An apparatus according to claim 19, wherein said photosensitive member is provided with a surface layer having a volume resistivity not less than $10^{9}$ Ohm.cm and not more than $10^{14}$ Ohm.cm.

* * * * *

UNITED STATES PATENT AND TRADEMARK OFFICE

CERTIFICATE OF CORRECTION

PATENT NO. : 6,128,456
DATED : October 3, 2000
INVENTOR(S) : Yasunori Chigono, et al.

It is certified that error appears in the above-identified patent and that said Letters Patent is hereby corrected as shown below:

Column 17,
Line 20, "provided" should read -- providing --.

Column 50,
Line 21, "an" should read -- wherein an --.

Signed and Sealed this

Sixth Day of November, 2001

*Attest:*

Nicholas P. Godici

*Attesting Officer*

NICHOLAS P. GODICI
*Acting Director of the United States Patent and Trademark Office*